US010272681B2

(12) United States Patent
Nishikawa et al.

(10) Patent No.: US 10,272,681 B2
(45) Date of Patent: Apr. 30, 2019

(54) LIQUID JET HEAD WITH PLURAL ROWS OF ALTERNATELY ARRANGED JET CHANNELS AND DUMMY CHANNELS AND LIQUID JET APPARATUS USING SAME

(71) Applicant: SII Printek Inc., Chiba-shi, Chiba (JP)

(72) Inventors: Daichi Nishikawa, Chiba (JP); Yoshinori Domae, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 15/273,308

(22) Filed: Sep. 22, 2016

(65) Prior Publication Data

US 2017/0087840 A1 Mar. 30, 2017

(30) Foreign Application Priority Data

Sep. 30, 2015 (JP) ..... 2015-194567

(51) Int. Cl.
*B41J 2/14* (2006.01)

(52) U.S. Cl.
CPC ..... *B41J 2/14201* (2013.01); *B41J 2/14209* (2013.01); *B41J 2002/14491* (2013.01)

(58) Field of Classification Search
CPC ..... B41J 2/14201; B41J 2/14209; B41J 2002/14491
See application file for complete search history.

(56) References Cited

U.S. PATENT DOCUMENTS

| | | | | |
|---|---|---|---|---|
| 2004/0070655 | A1* | 4/2004 | Aoi | C09D 11/38 347/100 |
| 2004/0251785 | A1 | 12/2004 | Takeuchi et al. | 310/328 |
| 2013/0088548 | A1 | 4/2013 | Saito et al. | 347/68 |
| 2014/0085379 | A1* | 3/2014 | Horiguchi | B41J 2/14209 347/40 |
| 2014/0085381 | A1 | 3/2014 | Yamamoto | 347/47 |
| 2014/0267500 | A1* | 9/2014 | Domae | B41J 2/14209 347/54 |

FOREIGN PATENT DOCUMENTS

| | | |
|---|---|---|
| EP | 1923219 | 5/2008 |
| EP | 2829404 | 1/2015 |
| JP | 2001232822 | 8/2001 |
| JP | 2014065150 | 4/2014 |

* cited by examiner

*Primary Examiner* — Henok Legesse
(74) *Attorney, Agent, or Firm* — Adams & Wilks

(57) ABSTRACT

A liquid jet head includes an actuator plate on which are formed ejection channels which extend in a channel extending direction and are filled with ink, and dummy channels which extend in the channel extending direction and are not filled with ink. A nozzle plate is laminated on the actuator plate and includes nozzle holes each communicating with a corresponding ejection channel at a central part in the channel extending direction of the ejection channel. The actuator plate includes a first channel row and a second channel row each of which includes the ejection channels and the dummy channels alternately arranged side by side in the X direction, the first and second channel rows being spaced apart in the channel extending direction. The ejection channels and the dummy channels are each symmetric with respect to a plane that passes through the center in the channel extending direction and perpendicular to the channel extending direction.

16 Claims, 20 Drawing Sheets

LIQUID JET HEAD WITH PLURAL ROWS OF ALTERNATELY ARRANGED JET CHANNELS AND DUMMY CHANNELS AND LIQUID JET APPARATUS USING SAME

BACKGROUND

Technical Field

The present invention relates to a liquid jet head and a liquid jet apparatus.

Related Art

Conventionally, there has been used an ink jet printer (liquid jet apparatus) provided with an ink jet head (liquid jet head) as an apparatus that ejects ink in the form of liquid droplets onto a recording medium such as a recording paper to record images or characters on the recording medium. The ink jet head is provided with an actuator plate on which ejection channels and dummy channels are alternately arranged side by side and a nozzle plate which includes nozzle holes communicating with the respective ejection channels.

In this configuration, drive walls each of which partitions between the ejection channel and the dummy channel are deformed to deform the ejection channels in an expand and contract manner in the actuator plate. As a result, ink inside the ejection channels is ejected through the nozzle holes.

For example, JP 2014-65150 A discloses a side shoot type ink jet head in which an ejection channel and a nozzle hole communicate with each other at a central part in the channel extending direction.

Further, JP 2014-65150 A discloses a configuration that includes two channel rows each of which includes ejection channels and dummy channels and which are spaced apart from each other in the channel extending direction to enable high resolution and high speed printing. In this case, the actuator plate includes a partition wall which is formed between the channel rows in the channel extending direction and partitions between the channel rows.

The behavior of the deformation of the ejection channel during the ejection of ink varies depending on the shape of drive wall (the inner face shape of the dummy channel).

However, in the configuration of JP 2014-65150 A, since the partition wall is formed on the actuator plate, the shape of the drive wall (the inner face shape of the dummy channel) differs between one end side and the other end side in the channel extending direction. Thus, during the ejection of ink, the balance of the deformation may be lost between one end side and the other end side in the channel extending direction when the ejection channel is deformed in an expand and contract manner. As a result, an ejection failure such as deflection of the ink ejection direction may occur.

SUMMARY OF THE INVENTION

The present invention has been made in view of the above circumstances, and an object thereof is to provide a liquid jet head and a liquid jet apparatus that enable a stable ejection performance to be obtained.

The present invention provides the following means to solve the above problem.

A liquid jet head according to the present invention includes: an actuator plate; a plurality of jet channels formed on the actuator plate, each of the jet channels extending along a first direction and being filled with liquid; a plurality of dummy channels formed on the actuator plate, each of the dummy channels extending along the first direction and not being filled with liquid; a jet hole plate laminated on the actuator plate and including a plurality of jet holes, each of the jet holes communicating with the corresponding one of the jet channels at a midway part in the first direction of the jet channel, wherein the actuator plate includes a first channel row including the jet channels and the dummy channels alternately arranged side by side in a second direction intersecting the first direction and a second channel row including the jet channels and the dummy channels alternately arranged side by side in the second direction, the first channel row and the second channel row being spaced apart from each other in the first direction, each of the jet channels is symmetric with respect to a plane that passes through a center in the first direction of the jet channel and perpendicular to the first direction, and each of the dummy channel is symmetric with respect to a plane that passes through a center in the first direction of the dummy channel and perpendicular to the first direction.

This configuration enables the jet channel to be deformed with a good balance between one end side and the other end side in the first direction when the jet channel is deformed in an expand and contract manner during the ejection of liquid. Accordingly, it is possible to reduce the occurrence of an ejection failure such as deflection and obtain a stable jet performance.

In the liquid jet head according to the present invention, each of the jet channels of the first channel row and each of the jet channels of the second channel row which face each other in the first direction may be arranged on an identical straight line along the first direction, and each of the dummy channels of the first channel row and each of the dummy channels of the second channel row which face each other in the first direction may be arranged on an identical straight line in the first direction.

This configuration enables the jet channel to be more easily formed in a plane-symmetrical manner and enables the dummy channel to be more easily formed in a plane-symmetrical manner, compared to the case in which, in each of the channel rows, the jet channels facing each other in the first direction are offset in the second direction and the dummy channels facing each other in the first direction are offset in the second direction.

In the liquid jet head according to the present invention, the dummy channels of the first channel row and the dummy channels of the second channel rows may be open on respective end faces in the first direction of the actuator plate, the actuator plate may include communication portions configured to allow the dummy channels of the first channel row and the dummy channels of the second channel row to communicate with each other, the communication portions being formed between the first channel row and the second channel row, and the communication portions may have a groove depth equal to a groove depth of the dummy channels.

In this configuration, the communication portion which allows the dummy channels facing each other in the first direction between the channel rows has a groove depth that is equal to the groove depth of the dummy channel. Thus, the dummy channel can be more reliably and easily plane-symmetrically formed. For example, when the electrodes are formed inside the channels by electroless plating and electrode materials are adhered to the bottom faces of the dummy channels and the communication portions, the electrode materials can be collectively removed throughout the dummy channels and the communication portions. As a result, it is possible to prevent the individual electrodes formed on the inner side faces that face each other in the second direction in the inner face of the dummy channel from being electrically connected to each other through the bottom face of the dummy channel in each of the channel rows.

The liquid jet head according to the present invention may further include: a plurality of common electrodes formed on inner faces of the jet channels; and a plurality of individual electrodes formed on inner side faces facing each other in the second direction in inner faces of the dummy channels.

In this configuration, when drive voltage is applied to each of the electrodes, the capacity of the jet channel changes due to the thickness-shear deformation of two drive walls which define the jet channel. Then, the drive walls are restored to the original state, and the capacity of the jet channel is returned to the original capacity by making the drive voltage applied to each of the electrodes zero. In the process of the deformation, liquid is introduced into the jet channel by the increase in the capacity of the jet channel. On the other hand, when the capacity of the jet channel is reduced, the pressure inside the jet channel increases to pressurize the liquid. As a result, the liquid is jetted to the outside through the jet hole, which enables characters or images to be recorded on a recording medium.

In the liquid jet head according to the present invention, the actuator plate may include a plurality of individual pads formed on a principal face of the actuator plate or a face opposite to the principal face, each of the individual pads being configured to connect the corresponding two of the individual electrodes facing each other in the second direction across the jet channel.

In the liquid jet head according to the present invention, the actuator plate may include a plurality of common pads formed on a principal face of the actuator plate or a face opposite to the principal face, the common pads being connected to the common electrodes.

This configuration enables the individual electrodes and the common electrodes to be connected to external wiring through the individual pads and the common pads on the principal face of the actuator plate or the face opposite to the principal face. Accordingly, the configuration can be simplified.

In the liquid jet head according to the present invention, the actuator plate may include communication portions formed between the first channel row and the second channel row, each of the communication portions being configured to allow each of the dummy channels of the first channel row and each of the dummy channels of the second channel row which face each other in the first direction to communicate with each other, and the individual electrodes may be formed in a part other than inner faces of the communication portions in the inner faces of the corresponding dummy channels in the first channel row and the second channel row and the corresponding communication portions.

This configuration makes it possible to prevent the individual electrodes formed on the inner faces of the dummy channels that face each other in the first direction from being electrically connected to each other through the inner face of the communication portion between the channel rows.

In the liquid jet head according to the present invention, the actuator plate may include communication portions formed between the first channel row and the second channel row, each of the communication portions being configured to allow each of the dummy channels of the first channel row and each of the dummy channels of the second channel row which face each other in the first direction to communicate with each other, and the actuator plate may include a separation groove formed between the first channel row and the second channel row, the separation groove being configured to electrically separate the individual electrodes at least between each of the dummy channels of the first channel row and each of the dummy channels of the second channel row which face each other in the first direction.

With this configuration, the individual electrodes inside the dummy channels of the channel rows which face each other in the first direction can be separated by the separation groove when the electrodes are formed inside the channels by, for example, electroless plating. Accordingly, it is possible to prevent the individual electrodes formed on the inner faces of the dummy channels that communicate with each other through the communication portion from being electrically connected to each other through the inner face of the communication portion.

In the liquid jet head according to the present invention, bypass electrodes may be formed on an inner face of the separation groove, each of the bypass electrodes being configured to connect the corresponding two of the individual electrodes facing each other in the second direction across the jet channel.

This configuration makes it possible to ensure reliability in the electrical connection by connecting the individual electrodes that face each other in the second direction across the jet channel by the bypass electrode.

In the liquid jet head according to the present invention, the actuator plate may include a first piezoelectric plate and a second piezoelectric plate that are polarized in different directions in a third direction corresponding to a groove depth direction of the jet channels and the dummy channels, the first piezoelectric plate and the second piezoelectric plate being laminated in the third direction, the common electrodes may be formed across the first piezoelectric plate and the second piezoelectric plate on the inner faces of the jet channels, and the individual electrodes may be formed across the first piezoelectric plate and the second piezoelectric plate on the inner side faces facing each other in the second direction in the inner faces of the dummy channels.

The amount of heat generated in the actuator plate is proportional to the capacitance of the drive walls which partition between the jet channels and the dummy channels and also proportional to the square of the voltage. Thus, in order to reduce the heat generation in the actuator plate, it is preferred to deform the jet channels (drive walls) with a low voltage.

Thus, in the configuration of the present invention, the area of each of the electrodes can be increased by forming the common electrodes and the individual electrodes across the first piezoelectric plate and the second piezoelectric plate on the inner faces of the channels. Accordingly, it is possible to deform the jet channels (drive walls) with a low voltage. Thus, even when the width in the second direction of the drive walls is reduced along with a reduction in the pitch of the jet channels, the heat generation in the liquid jet head caused by an increased in the capacitance can be reduced.

In the liquid jet head according to the present invention, the jet holes may include: first jet holes communicating with the respective jet channels of the first channel row; and second jet holes communicating with the respective jet channels of the second channel row, and the first jet holes and the second jet holes may be alternately arrayed in a staggered form in the second direction.

In this configuration, the jet holes are alternately arranged in a staggered form in the second direction. Thus, the density of liquid landing on an identical straight line can be improved by causing liquid ejected from the jet holes to land on an identical straight line along the second direction while moving the liquid jet head in the direction perpendicular to the extending direction of the first channel row and the second channel row on the recording medium. Accordingly, high resolution can be achieved.

A liquid jet apparatus according to the present invention includes: the liquid jet head according to any one of claims 1 to 11; and a movement mechanism configured to relatively move the liquid jet head and a recording medium.

In this configuration, the liquid jet apparatus is provided with the liquid jet head according to the present invention described above. Thus, a printer having high performance and high reliability can be provided.

The present invention enables a stable ejection performance to be obtained.

DETAILED DESCRIPTION

Figure 1:
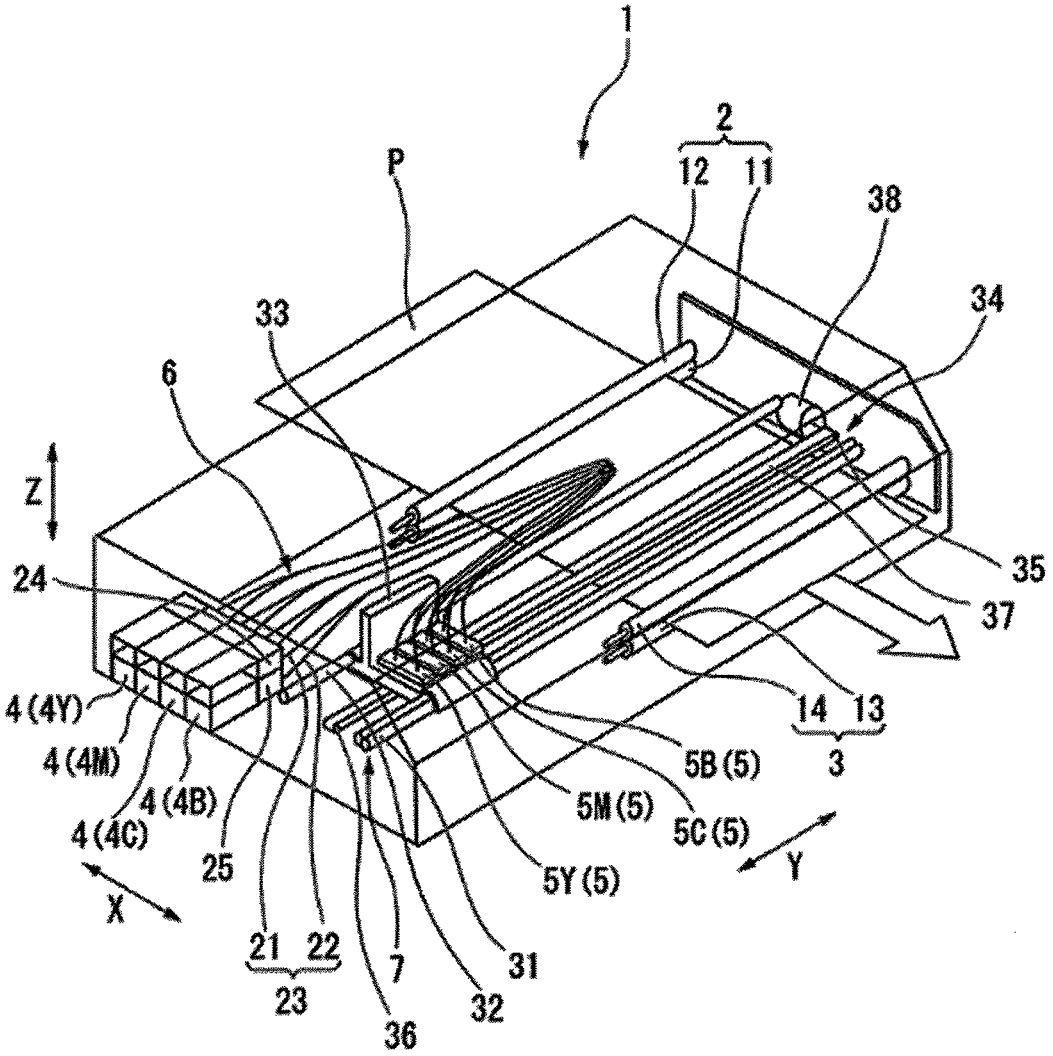
FIG. 1 is a schematic configuration diagram of an ink jet printer.

Hereinbelow, embodiments according to the present invention will be described with reference to the drawings. In the following embodiments, an ink jet printer (hereinbelow, merely referred to as "printer") which performs recording on a recording medium using ink (liquid) will be described as an example of a liquid jet apparatus provided with a liquid jet head of the present invention. In the drawings used in the following description, the scale of each component is appropriately changed so as to have a recognizable size.

(First Embodiment)

[Printer]

FIG. 1 is a schematic configuration diagram of a printer 1.

As illustrated in FIG. 1, the printer 1 of a first embodiment is provided with a pair of conveyance units 2, 3 which conveys a recording medium P such as paper, an ink tank 4 which stores ink therein, an ink jet head (liquid jet head) 5 which ejects ink in the form of liquid droplets onto the recording medium P, an ink circulation unit 6 which circulates ink between the ink tank 4 and the ink jet head 5, and a scanning unit (movement mechanism) 7 which moves the ink jet head 5 in a direction (a width direction of the recording medium P (hereinbelow, referred to as a Y direction)) that is perpendicular to a conveyance direction (hereinbelow, referred to as an X direction) of the recording medium P. A Z direction in the drawings indicates a height direction that is perpendicular to the X direction and the Y direction.

The conveyance unit 2 is provided with a grid roller 11 which extends in the Y direction, a pinch roller 12 which extends parallel to the grid roller 11, and a drive mechanism (not illustrated), for example, a motor which axially rotates the grid roller 11. Similarly, the conveyance unit 3 is provided with a grid roller 13 which extends in the Y direction, a pinch roller 14 which extends parallel to the grid roller 13, and a drive mechanism (not illustrated) which axially rotates the grid roller 13.

The ink tank 4 includes, for example, ink tanks 4Y, 4M, 4C, 4B which respectively store therein four colors of ink, specifically, yellow ink, magenta ink, cyan ink, and black ink. The ink tanks 4Y, 4M, 4C, 4B are arranged side by side in the X direction.

Figure 2:
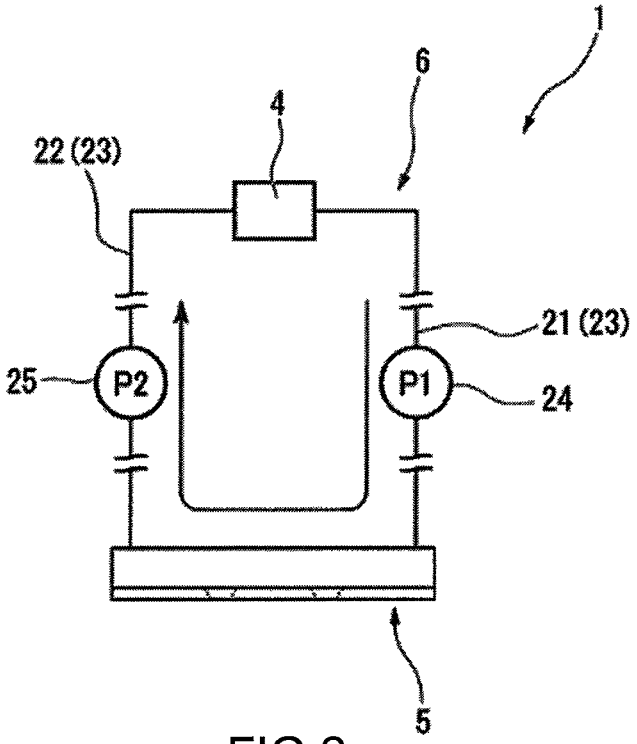
FIG. 2 is a schematic configuration diagram of an ink jet head and an ink circulation unit.

FIG. 2 is a schematic configuration diagram of the ink jet head 5 and the ink circulation unit 6.

As illustrated in FIGS. 1 and 2, the ink circulation unit 6 is provided with a circulation flow path 23 which includes an ink supply tube 21 for supplying ink to the ink jet head 5 and an ink discharge tube 22 for discharging ink from the ink jet head 5, a pressurizing pump 24 which is connected to the ink supply tube 21, and a suction pump 25 which is connected to the ink discharge tube 22. The ink supply tube 21 and the ink discharge tube 22 include flexible hoses having flexibility and capable of following the action of the scanning unit 7 which supports the ink jet head 5.

The pressurizing pump 24 pressurizes the inside of the ink supply tube 21 to pump out ink to the ink jet head 5. Accordingly, the ink supply tube 21 has a positive pressure relative to the ink jet head 5.

The suction pump 25 depressurizes the inside of the ink discharge tube 22 to suck ink from the ink jet head 5. Accordingly, the ink discharge tube 22 has a negative pressure relative to the ink jet head 5. Ink can circulate between the ink jet head 5 and the ink tank 4 through the circulation flow path 23 by the drive of the pressurizing pump 24 and the suction pump 25.

As illustrated in FIG. 1, the scanning unit 7 is provided with a pair of guide rails 31, 32 which extend in the Y direction, a carriage 33 which is movably supported by the pair of guide rails 31, 32, and a drive mechanism 34 which moves the carriage 33 in the Y direction. The drive mechanism 34 is provided with a pair of pulleys 35, 36 which is disposed between the guide rails 31, 32, an endless belt 37 which is wound around the pair of pulleys 35, 36, and a drive motor 38 which drives the pulley 35 to rotate.

The pulley 35 is disposed between one end of the guide rail 31 and one end of the guide rail 32, and the pulley 36 is disposed between the other end of the guide rail 31 and the other end of the guide rail 32. The endless belt 37 is disposed between the guide rails 31, 32. The carriage 33 is coupled to the endless belt 37. A plurality of ink jet heads 5, specifically, ink jet heads 5Y, 5M, 5C, 5B which respectively eject four colors of ink, specifically, yellow ink, magenta ink, cyan ink, and black ink are arranged side by side in the Y direction and mounted on the carriage 33. The conveyance units 2, 3 and the scanning unit 7 constitute a movement mechanism which relatively moves the ink jet head 5 and the recording medium P.

<Ink Jet Head>

Next, the ink jet head 5 will be specifically described. All the ink jet heads 5Y, 5M, 5C, 5B have the same configuration except the color of ink supplied thereto. Thus, in the following description, the ink jet heads 5Y, 5M, 5C, 5B will be collectively described as the ink jet head 5.

Figure 3:
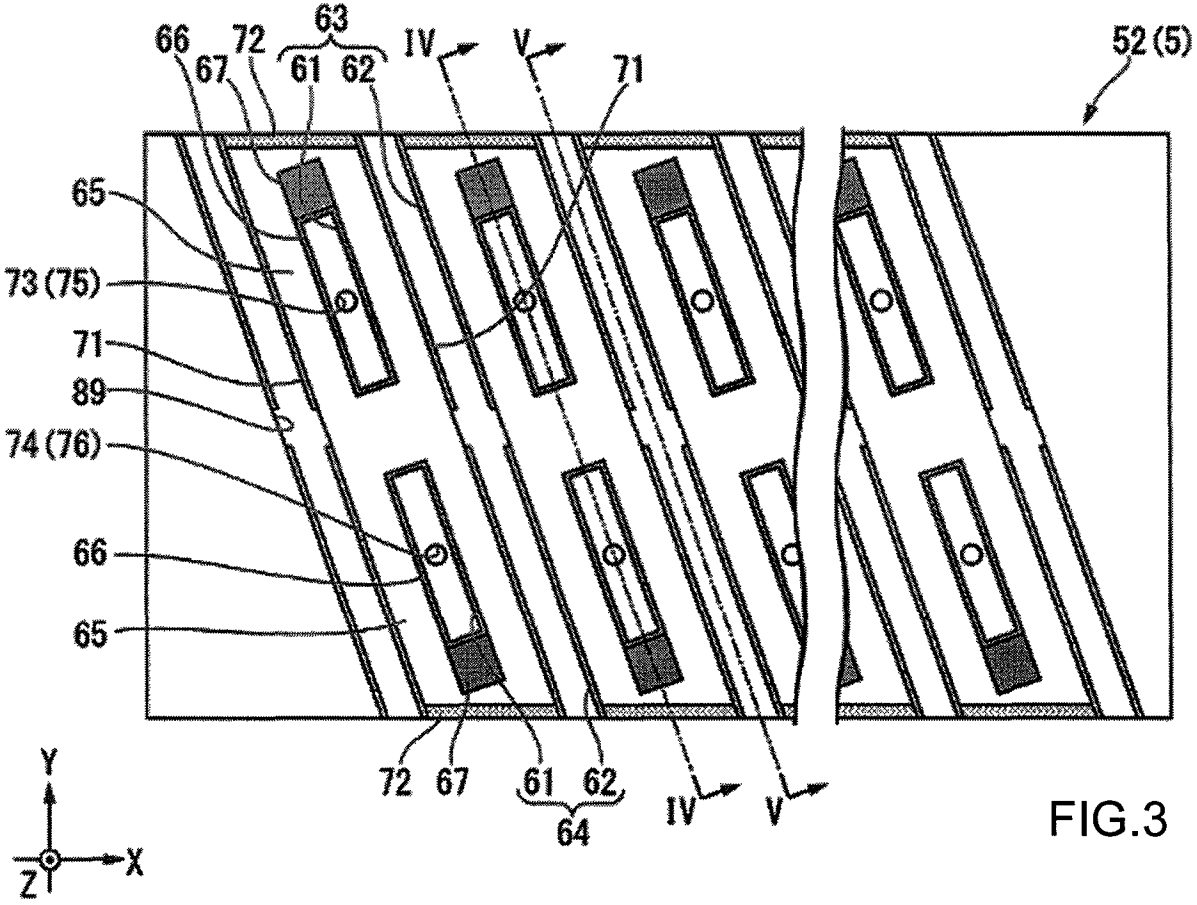
FIG. 3 is a plan view illustrating the ink jet head according to a first embodiment with a cover plate detached.
Figure 4:
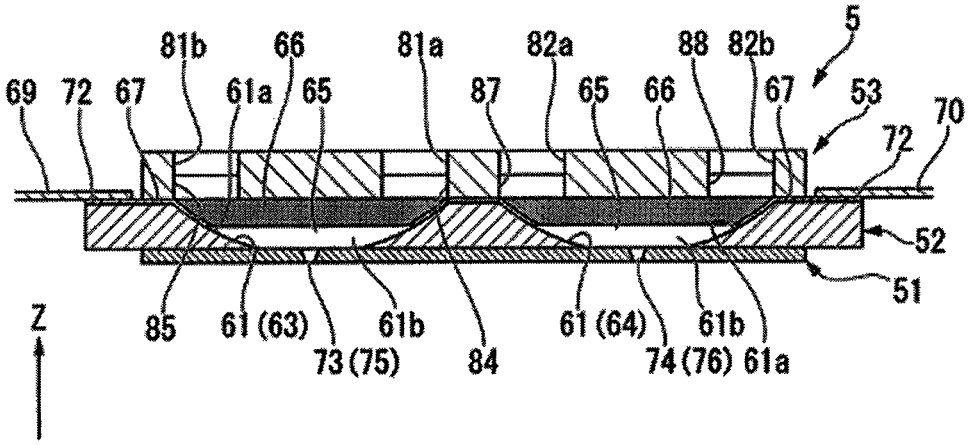
FIG. 4 is a sectional view taken along line IV-IV of FIG. 3.
Figure 5:
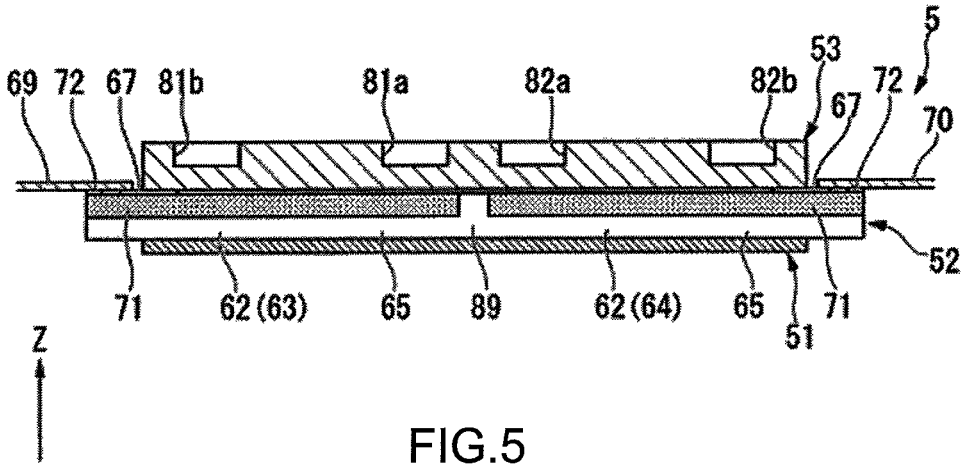
FIG. 5 is a sectional view taken along line V-V of FIG. 3.

FIG. 3 is a plan view illustrating the ink jet head 5 with a cover plate 53 detached. FIG. 4 is a sectional view taken along line IV-IV of FIG. 3. FIG. 5 is a sectional view taken along line V-V of FIG. 3.

As illustrated in FIGS. 3 to 5, each of the ink jet heads 5 is a side shoot type ink jet head which ejects ink from the central part in a channel extending direction (first direction) of an ejection channel 61 (described below). More specifically, the ink jet head 5 is also a circulation type ink jet head which circulates ink between the ink jet head 5 and the ink tank 4. Further more specifically, the ink jet head 5 of the present embodiment is a two-array type ink jet head 5 in which a nozzle array 73 including a plurality of nozzle holes 75 and a nozzle array 74 including a plurality of nozzle holes 76 are formed in two rows.

As illustrated in FIGS. 4 and 5, the ink jet head 5 is mainly provided with a nozzle plate (jet hole plate) 51, an actuator plate 52, and a cover plate 53. In the ink jet head 5, the nozzle plate 51, the actuator plate 52, and the cover plate 53 are laminated in this order in the Z direction, for example, with an adhesive. In the following description, the side corresponding to the cover plate 53 is defined as an upper side and the side corresponding to the nozzle plate 51 is defined as a lower side in the Z direction.

<Actuator Plate>

The actuator plate 52 is formed of a piezoelectric material such as lead zirconate titanate (PZT). The actuator plate 52 is a monopole substrate whose polarization direction is set at one direction along the thickness direction (Z direction). The actuator plate 52 includes two channel rows (a first channel row 63 and a second channel row 64) each of which includes a plurality of channels 61, 62 arranged side by side at intervals in the X direction (second direction). In the following description, the first channel row 63 will be mainly described. A part in the second channel row 64 corresponding to the first channel row 63 will be designated by the same reference sign, and description thereof will be omitted.

As illustrated in FIG. 3, the first channel row 63 includes ejection channels (jet channels) 61 which are filled with ink and dummy channels 62 which are not filled with ink. The channels 61, 62 are alternately arranged side by side in the X direction. Each part of the actuator plate 52 located between the ejection channel 61 and the dummy channel 62 constitutes a drive wall 65 which partitions between the ejection channel 61 and the dummy channel 62 in the X direction.

The ejection channel 61 extends in the Y direction in plan view in the Z direction. Specifically, the ejection channel 61 of the present embodiment extends in a direction (hereinbelow, merely referred to as a channel extending direction) intersecting the Y direction in plan view in the Z direction.

As illustrated in FIG. 4, the ejection channel 61 is formed in a curved shape projecting downward in plan view in the X direction. Specifically, the ejection channel 61 includes raise parts 61*a* which are located on the respective ends in the channel extending direction and an intermediate part 61*b* which is located between the raise parts 61*a*.

Each of the raise parts 61*a* extends in a manner to bend or curve upward toward the outer side in the channel extending direction.

The intermediate part 61*b* penetrates the actuator plate 52 in the Z direction.

As illustrated in FIG. 3, in the actuator plate 52, the dummy channels 62 extends parallel to the ejection channels 61 on each side in the X direction of each of the ejection channels 61. As illustrated in FIG. 5, the dummy channel 62 has a uniform groove width in the Z direction (third direction) throughout the entire length thereof. In the present embodiment, the dummy channel 62 penetrates the actuator plate 52 in the Z direction. An outer end in the channel extending direction of the dummy channel 62 is open on an outer end face in the Y direction of the actuator plate 52. In the present embodiment, the length in the channel extending direction of the dummy channel 62 is longer than that of the ejection channel 61. Thus, in side view in the X direction, the dummy channel 62 overlaps the entire ejection channel 61, and both ends in the channel extending direction of the dummy channel 62 project outward in the channel extending direction with respect to the ejection channel 61. The length of the dummy channel 62 is a distance between a boundary between a communication portion 89 (described below) and the dummy channel 62 and the outer end face in the Y direction of the actuator plate 52 in the channel extending direction. On the other hand, the length of the ejection channel 61 is a distance between ends of the raise parts 61*a* in the channel extending direction.

As illustrated in FIGS. 3 and 4, a common electrode 66 is formed on an inner face of each of the ejection channels 61. The common electrode 66 is continuously formed throughout the entire circumference of the inner face of the ejection channel 61 (inner side faces facing in the X direction and bottom faces of the raise parts 61*a*).

As illustrated in FIG. 4, the positions of terminals (the outer edges in the channel extending direction) of the raise parts 61*a* are aligned with opening ends of supply slits 84, 87 and discharge slits 85, 88 formed directly under inlet side common ink chambers (a first inlet side common ink chamber 81*a* and a second inlet side common ink chamber 82*a*) and outlet side common ink chambers (a first outlet side common ink chamber 81*b* and a second outlet side common ink chamber 82*b*) of the cover plate 53 described later in the Z direction. More specifically, the positions of the terminals of the raise parts 61*a* are aligned with, in the drawing, a right end in the channel extending direction of the supply slit 84, a left end in the channel extending direction of the supply slit 87, a left end in the channel extending direction of the discharge slit 85, and a right end in the channel extending direction of the discharge slit 88. Thus, the common electrode 66 is formed up to the positions of the terminals of the raise parts 61*a*.

The common electrode 66 is formed in a range of the ejection channel 61 from an upper edge to a central part in the Z direction.

The actuator plate 52 includes common pads 67 each of which is formed on the upper face of each part located on the outer side in the Y direction with respect to the ejection channel 61 (hereinbelow, merely referred to as a tail part). The common pad 67 is formed in a band shape extending in the channel extending direction. An inner end in the channel extending direction of the common pad 67 is connected to the common electrode 66, and an outer end in the channel extending direction thereof terminates on the tail part of the actuator plate 52.

As illustrated in FIGS. 3 and 5, the actuator plate 52 includes individual electrodes 71 which are formed on faces of the drive walls 65, the faces defining the dummy channels 62 (the inner faces of the dummy channels 62). The individual electrodes 71 are formed on inner side faces that face each other in the X direction in the inner face of each of the dummy channels 62. Thus, the individual electrodes 71 that face each other in each of the dummy channels 62 are electrically separated from each other. The individual electrode 71 is formed in a range of the dummy channel 62 from an upper edge to a central part in the Z direction. In the illustrated example, the individual electrode 71 is formed throughout the entire range in the channel extending direction of the dummy channel 62.

As illustrated in FIG. 3, the actuator plate 52 includes individual pads 72 each of which is formed on the upper face of the tail part of the actuator plate 52 and connects the individual electrodes 71 that face each other in the X direction across the ejection channel 61. The individual pad 72 is located on the outer side in the Y direction with respect to the common pad 67 and extends in the X direction on the tail part of the actuator plate 52. One end in the X direction of the individual pad 72 is connected to the individual electrode 71 that is formed, inside the dummy channel 62 located on one end side in the X direction with respect to the ejection channel 61, on the other end side in the X direction. On the other hand, the other end in the X direction of the individual pad 72 is connected to the individual electrode 71 that is formed, inside the dummy channel 62 located on the other end side in the X direction with respect to the ejection channel 61, on one end side in the X direction.

As illustrated in FIGS. 4 and 5, flexible printed circuit boards 69, 70 which connect a control unit (not illustrated) to each of the pads 67, 72 are mounted on the tail parts of the actuator plate 52. Accordingly, drive voltage is applied to each of the electrodes 66, 71 from the control unit through the flexible printed circuit boards 69, 70.

The second channel row 64 includes ejection channels 61 and dummy channels 62 which are alternately arranged side by side in the X direction similarly to the first channel row 63. The ejection channels 61 and the dummy channels 62 of the second channel row 64 are formed at the same arraying pitch as the ejection channels 61 and the dummy channels 62 of the first channel row 63. In this case, each of the ejection channels 61 of the channel row 63 and each of the ejection channels 61 of the channel row 64 which face each other in the channel extending direction are arranged on an identical straight line in the channel extending direction. Further, each of the dummy channels 62 of the channel row 63 and each of the dummy channels 62 of the channel row 64 which face each other in the channel extending direction are arranged on an identical straight line in the channel extending direction.

<Nozzle Plate>

As illustrated in FIGS. 4 and 5, the nozzle plate 51 is adhered to the lower face of the actuator plate 52. In the present embodiment, the nozzle plate 51 blocks the intermediate part 61*b* of each of the ejection channels 61 and each of the dummy channels 62 from the lower side.

The nozzle plate 51 includes two nozzle arrays (a first nozzle array 73 and a second nozzle array 74) which extend parallel to each other in the X direction and spaced apart from each other in the Y direction.

The first nozzle array 73 includes a plurality of first nozzle holes (first jet holes) 75 each of which penetrates the nozzle plate 51 in the Z direction. The first nozzle holes 75 are arranged side by side on a straight line at intervals in the X direction. The first nozzle holes 75 communicate with the respective ejection channels 61 of the first channel row 63. Specifically, each of the first nozzle holes 75 is located on the central part in the channel extending direction of the corresponding ejection channel 61 of the first channel row 63. The first nozzle holes 75 are formed at the same arraying pitch as the ejection channels 61 of the first channel row 63 in the X direction.

The second nozzle array 74 includes a plurality of second nozzle holes (second jet holes) 76 each of which penetrates the nozzle plate 51 in the Z direction. The second nozzle holes 76 are arranged side by side on a straight line at intervals in the X direction in parallel to the first nozzle array 73. The second nozzle holes 76 communicate with the respective ejection channels 61 of the second channel row 64. Specifically, each of the second nozzle holes 76 is located on the central part in the channel extending direction of the corresponding ejection channel 61 of the second channel row 64. The second nozzle holes 76 are formed at the same arraying pitch as the ejection channels 61 of the second channel row 64 in the X direction. Thus, the dummy channels 62 of the channel rows 63, 64 do not communicate with the nozzle holes 75, 76, and are covered with the nozzle plate 51 from the lower side. Each of the nozzle holes 75, 76 has a tapered shape whose diameter is gradually reduced toward the lower side.

As illustrated in FIG. 3, the nozzle holes 75, 76 are formed at positions offset in the X direction. That is, the nozzle holes 75, 76 are alternately arrayed (in a staggered form) in the X direction. The offset amount of the nozzle holes 75, 76 can be appropriately changed. For example, the nozzle holes 75, 76 may be offset by a half pitch.

<Cover Plate>

As illustrated in FIGS. 4 and 5, the cover plate 53 is adhered to the upper face of the actuator plate 52 so as to block the channel rows 63, 64. The width in the Y direction of the cover plate 53 is shorter than that of the actuator plate 52. In this case, the common pads 67 and the individual pads 72 are exposed on the tail parts of the actuator plate 52 at positions on the outer side in the Y direction with respect to the cover plate 53. Accordingly, the flexible printed circuit boards 69, 70 are connected to the common pads 67 and the individual pads 72.

The inlet side common ink chambers (the first inlet side common ink chamber 81*a* and the second inlet side common ink chamber 82*a*) and the outlet side common ink chambers (the first outlet side common ink chamber 81*b* and the second outlet side common ink chamber 82*b*) are formed on the cover plate 53. In the following description, the first inlet side common ink chamber 81*a* and the first outlet side common ink chamber 81*b* will be mainly described.

As illustrated in FIG. 4, the first inlet side common ink chamber 81*a* is formed in a part of the cover plate 53 that faces the inner end in the Y direction of the first channel row 63 (the ejection channels 61 and the dummy channels 62) in the Z direction. The first inlet side common ink chamber 81*a* is formed in a recessed groove shape that is recessed downward and extends in the X direction. Both ends in the X direction of the first inlet side common ink chamber 81*a* are located on the outer side in the X direction with respect to the first channel row 63. The first inlet side common ink chamber 81*a* includes the supply slits 84 each of which is formed at a position corresponding to the ejection channel 61 (the position facing the ejection channel 61 in the Z direction) and penetrates the cover plate 53 in the Z direction.

The first outlet side common ink chamber 81*b* is formed in a part of the cover plate 53 that faces the outer end in the Y direction of the first channel row 63 (the ejection channels 61 and the dummy channels 62) in the Z direction. The first outlet side common ink chamber 81*b* is formed in a recessed groove shape that is recessed downward and extends in the X direction. Both ends in the X direction of the first outlet side common ink chamber 81*b* are located on the outer side in the X direction with respect to the first channel row 63. The first outlet side common ink chamber 81*b* includes the discharge slits 85 each of which is formed at a position corresponding to the ejection channel 61 (the position facing the ejection channel 61 in the Z direction) and penetrates the cover plate 53 in the Z direction.

Thus, the first inlet side common ink chamber 81*a* and the first outlet side common ink chamber 81*b* communicate with the ejection channels 61 through the supply slits 84 and the discharge slits 85 and, on the other hand, do not communicate with the dummy channels 62. That is, each of the dummy channels 62 is blocked by the bottoms of the first inlet side common ink chamber 81*a* and the first outlet side common ink chamber 81*b*.

The second inlet side common ink chamber 82*a* is formed in a part of the cover plate 53 that faces the inner end in the Y direction of the second channel row 64 (the ejection channels 61 and the dummy channels 62) in the Z direction. The second outlet side common ink chamber 82*b* is formed in a part of the cover plate 53 that faces the outer end in the Y direction of the second channel row 64 (the ejection channels 61 and the dummy channels 62) in the Z direction.

The second inlet side common ink chamber 82*a* includes the supply slits 87 each of which is formed at a position corresponding to the ejection channel 61 (the position facing the ejection channel 61 in the Z direction). The second outlet side common ink chamber 82*b* includes the discharge slits 88 each of which is formed at a position corresponding to the ejection channel 61 (the position facing the ejection channel 61 in the Z direction).

As illustrated in FIGS. 3 and 5, the actuator plate 52 includes communication portions 89 each of which is located between the dummy channels 62 that face each other in the channel extending direction between the channel rows 63, 64 and allows the dummy channels 62 to communicate with each other. The depth in the Z direction of the communication portion 89 is equal to the groove depth of the dummy channel 62. That is, in the actuator plate 52, the dummy channels 62 and the communication portions 89 have a uniform depth.

In this case, in each of the channel rows 63, 64, each of the dummy channels 62 is symmetric with respect to a plane that passes through the center in the channel extending direction and perpendicular to the channel extending direction.

On the other hand, in each of the channel rows 63, 64, each of the ejection channels 61 is also symmetric with respect to a plane that passes through the center in the channel extending direction and perpendicular to the channel extending direction. The individual electrode 71 is not formed on the inner face of the communication portion 89. Thus, in the channel rows 63, 64, the individual electrodes 71 formed on the dummy channels 62 that face each other in the channel extending direction are electrically separated from each other by the communication portion 89.

An inner terminal in the channel extending direction of the individual electrode 71 is located on the inner side in the channel extending direction with respect to a position directly below the inlet side common ink chamber (the first inlet side common ink chamber 81*a* or the second inlet side common ink chamber 82*a*). However, the present invention is not limited to the present embodiment, and the inner terminal in the channel extending direction of the individual electrode 71 may be aligned with the position directly below the inlet side common ink chamber (the first inlet side common ink chamber 81*a* or the second inlet side common ink chamber 82*a*). In other words, it is only required that the length in the channel extending direction of the individual electrode 71 be equal to or longer than the length in the channel extending direction of the common electrode 66.

In such a configuration, each of the drive walls 65 of the ejection channels 61 is sandwiched by the common electrode 66 and the individual electrode 71 in the entire length in the channel extending direction. Thus, the drive walls 65 have a good driving balance, and ink in the form of liquid droplets can be jetted from the nozzle holes 75, 76 toward positions directly below the nozzle holes 75, 76 in the Z direction.

[Operating Method of Printer]

Next, recording of characters or figures onto the recording medium P using the printer 1 having the above configuration will be described below.

As an initial state, the four ink tanks 4 illustrated in FIG. 1 enclose therein different colors of ink in a sufficient amount. Further, ink inside each of the ink tanks 4 is filled into the corresponding ink jet head 5 through the ink circulation unit 6.

When the printer 1 is operated under such an initial state, the grid roller 11 of the conveyance unit 2 and the grid roller 13 of the conveyance unit 3 rotate, so that the recording medium P is conveyed in the conveyance direction (X direction) between the grid rollers 11, 13 and the pinch rollers 12, 14. At the same time, the drive motor 38 rotates the pulleys 35, 36 to move the endless belt 37. Accordingly, the carriage 33 reciprocates in the Y direction while being guided by the guide rails 31, 32.

During this operation, four colors of ink are appropriately ejected onto the recording medium P from the respective ink jet heads 5. In this manner, recording of characters or images can be performed.

Hereinbelow, the movement of each of the ink jet heads 5 will be described in detail.

In the side shoot and circulation type ink jet head 5 as described in the present embodiment, the pressurizing pump 24 and the suction pump 25 illustrated in FIG. 2 are first operated to circulate ink inside the circulation flow path 23. In this case, ink flowing in the ink supply tube 21 passes through the inlet side common ink chambers 81*a*, 82*a*, and is then supplied into the ejection channels 61 of the channel rows 63, 64 through the supply slits 84, 87. Further, the ink inside the ejection channels 61 flows into the outlet side common ink chambers 81*b*, 82*b* through the discharge slits 85, 88, and is then discharged to the ink discharge tube 22. The ink discharged to the ink discharge tube 22 is returned to the ink tank 4, and then again supplied to the ink supply tube 21. Accordingly, ink is circulated between the ink jet head 5 and the ink tank 4.

When the carriage 33 (refer to FIG. 1) starts reciprocating, the control unit applies drive voltage to the electrodes 66, 71 through the flexible printed circuit boards 69, 70. The voltage application produces thickness-shear deformation in two drive walls 65 that define each of the ejection channels 61, and the two drive walls 65 are deformed in a manner to project toward the dummy channels 62. The actuator plate 52 of the present embodiment is polarized in one direction, and each of the electrodes 66, 71 is formed only up to the intermediate part in the Z direction of the drive wall 65. Thus, each of the drive walls 65 is bent and deformed into a V shape curved from the intermediate part in the Z direction thereof by applying voltage between the electrodes 66, 71. As a result, the ejection channel 61 is deformed as if it swells.

In this manner, the capacity of the ejection channel 61 increases due to the deformation of the two drive walls 65 caused by a piezoelectric thickness-shear effect. Further, since the capacity of the ejection channel 61 increases, ink stored inside the inlet side common ink chamber 81*a*, 82*a* is introduced into the ejection channel 61. Then, the ink introduced into the ejection channel 61 propagates as a pressure wave inside the ejection channel 61. At the timing when the pressure wave reaches the corresponding nozzle hole 75, 76, the drive voltage applied to the electrodes 66, 71 is made zero. Accordingly, the deformed drive walls 65 are restored to the original state, and the capacity of the ejection channel 61 once increased is returned to the original capacity. This operation increases the pressure inside the ejection channel 61, thereby pressurizing ink inside thereof. As a result, ink in the form of liquid droplets is ejected to the outside through the corresponding nozzle hole 75, 76, which enables characters or images to be recorded on the recording medium P as described above.

[Method for Manufacturing Ink Jet Head]

Figure 6:
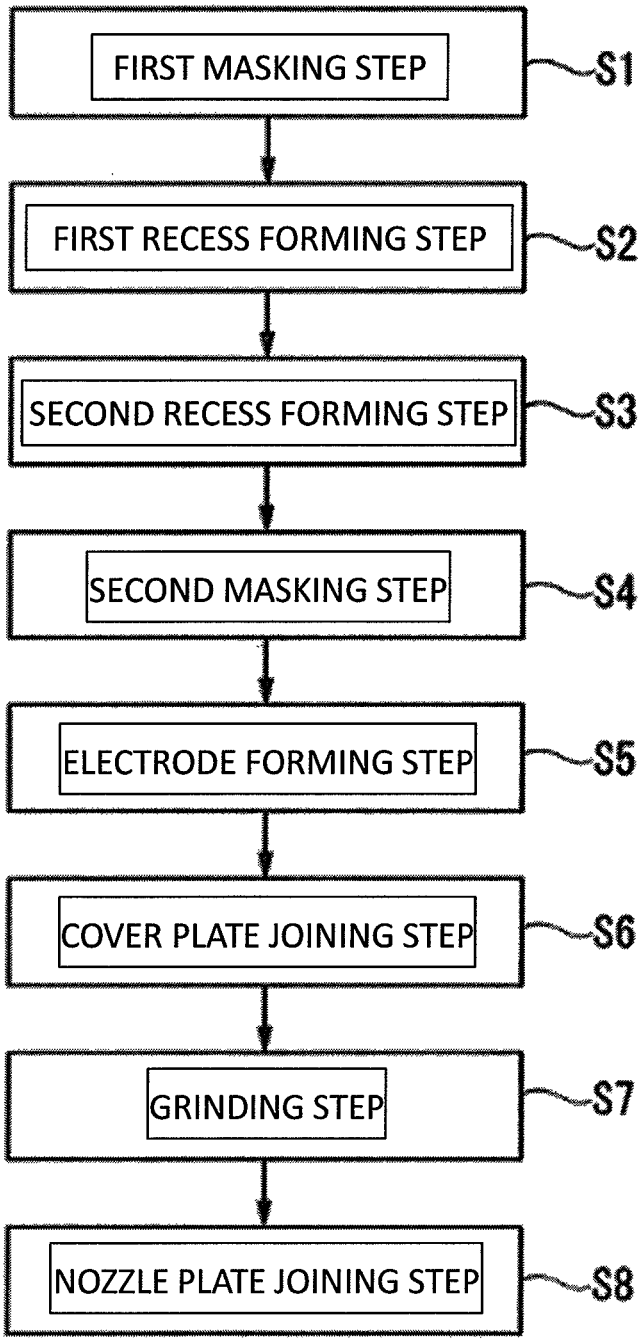
FIG. 6 is a flow chart for describing a method for manufacturing the ink jet head according to the first embodiment.

Next, a method for manufacturing the ink jet head 5 described above will be described. In the following description, a method for manufacturing the actuator plate 52 will be mainly described. FIG. 6 is a flow chart for describing the method for manufacturing the ink jet head 5. FIGS. 7 to 17 are step diagrams for describing the method for manufacturing the ink jet head 5.

Figure 7:
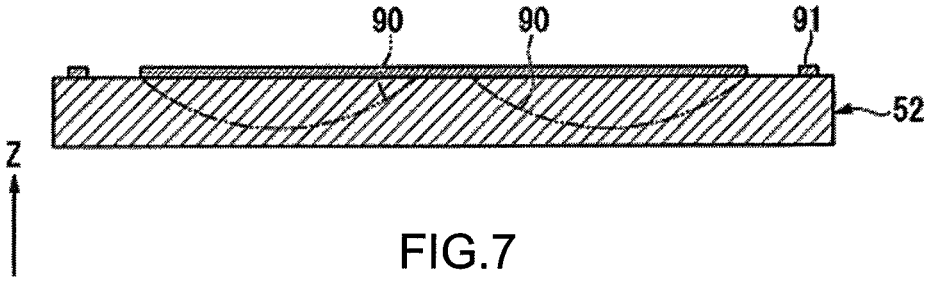
FIG. 7 is a step diagram for describing the method for manufacturing the ink jet head according to the first embodiment.
Figure 8:
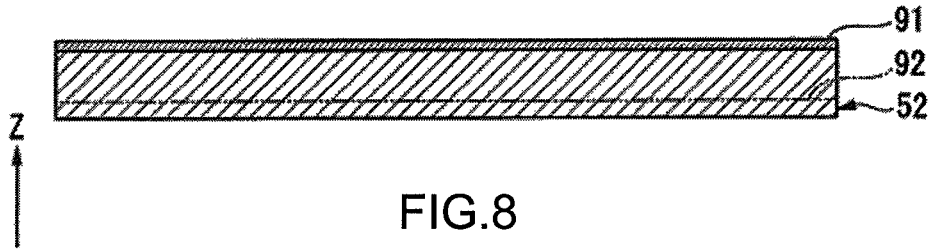
FIG. 8 is a step diagram for describing the method for manufacturing the ink jet head according to the first embodiment.

As illustrated in FIGS. 6 to 8, a first mask 91 which is used in an electrode forming step (S5) described below is first formed on the upper face of the actuator plate 52 (a first masking step (S1)). Specifically, a mask material, for example, a photosensitive dry film is first adhered to the upper face of the actuator plate 52. Then, the mask material is patterned using a photolithography technique to remove a part of the mask material that is located in a formation region of each of the pads 67, 72. Accordingly, the first mask 91 which has openings located in the formation regions of the pads 67, 72 is formed.

Figure 9:
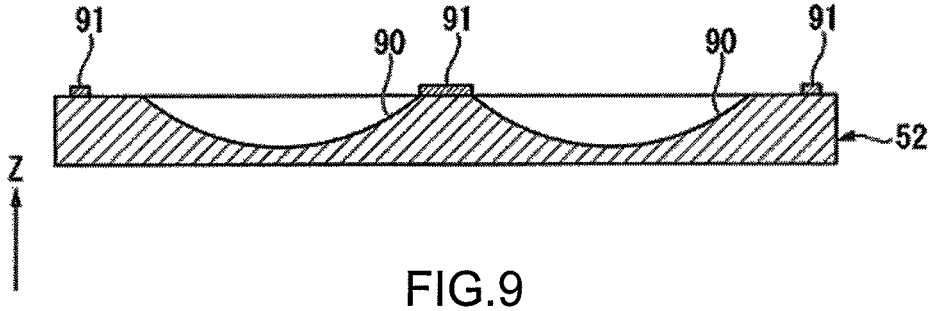
FIG. 9 is a step diagram for describing the method for manufacturing the ink jet head according to the first embodiment.

Then, as illustrated in FIGS. 6 and 9, a first recess 90 to be the ejection channel 61 is formed on the actuator plate 52 (a first recess forming step (S2)). The first recess forming step (S2) of the present embodiment forms the first recess 90 by cutting using a dicing blade. Specifically, the dicing blade is introduced into the actuator plate 52 from the upper face thereof to form the first recess 90 having a predetermined depth on the actuator plate 52. The first recess 90 has a circular arc shape following the curvature radius of the dicing blade in side view in the X direction and has a Z-direction depth that does not allow the first recess 90 to penetrate the actuator plate 52.

Then, a plurality of first recesses 90 are formed on the actuator plate 52 at intervals in the X direction and the channel extending direction. At this time, each two of the first recesses 90 that are adjacent to each other in the channel extending direction (each of the ejection channels 61 of the channel row 63 and each of the ejection channels 61 of the channel row 64 which face each other in the channel extending direction) are arranged on an identical straight line.

Figure 10:
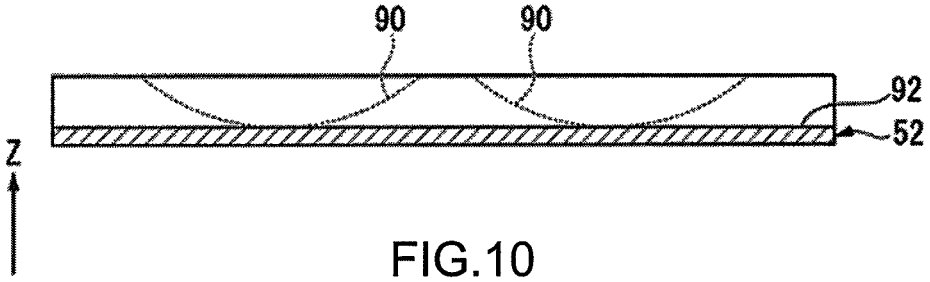
FIG. 10 is a step diagram for describing the method for manufacturing the ink jet head according to the first embodiment.

Then, as illustrated in FIGS. 6 and 10, a second recess 92 to be the dummy channel 62 and the communication portion 89 is formed on the actuator plate 52 (a second recess forming step (S3)). The second recess forming step (S3) is performed by cutting using a dicing blade similarly to the first recess forming step (S2) described above. Specifically, the dicing blade is introduced into the actuator plate 52 from the upper face thereof at a part located on each side in the X direction of the first recess 90. At this time, the second recess 92 has a uniform groove depth throughout the entire range in the channel extending direction of the actuator plate 52.

Figure 11:
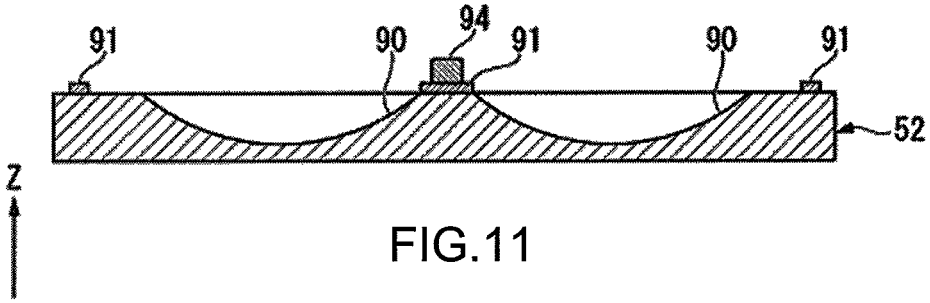
FIG. 11 is a step diagram for describing the method for manufacturing the ink jet head according to the first embodiment.
Figure 12:
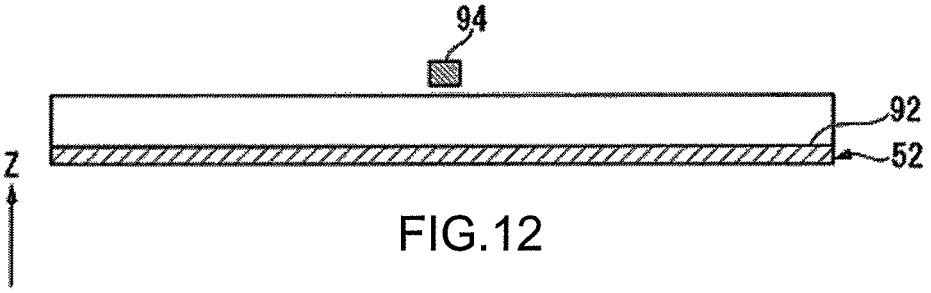
FIG. 12 is a step diagram for describing the method for manufacturing the ink jet head according to the first embodiment.

Then, as illustrated in FIGS. 6, 11, and 12, a second mask 94 which is used in the electrode forming step (S5) described below is set on the upper face of the actuator plate 52 (a second masking step (S4)). In the second masking step (S4), the second mask 94 is set to cover a part located between the channel rows 63, 64 in the Y direction on the upper face of the actuator plate 52. In this case, as illustrated in FIG. 11, the entire first recesses 90 are open through the second mask 94. On the other hand, as illustrated in FIG. 12, only a part corresponding to each dummy channel 62 is open in the second recess 92 through the second mask 94 (a part corresponding to the communication portion 89 is covered with the second mask 94). For example, a metal mask or a photosensitive dry film can be used as the second mask 94.

Figure 13:
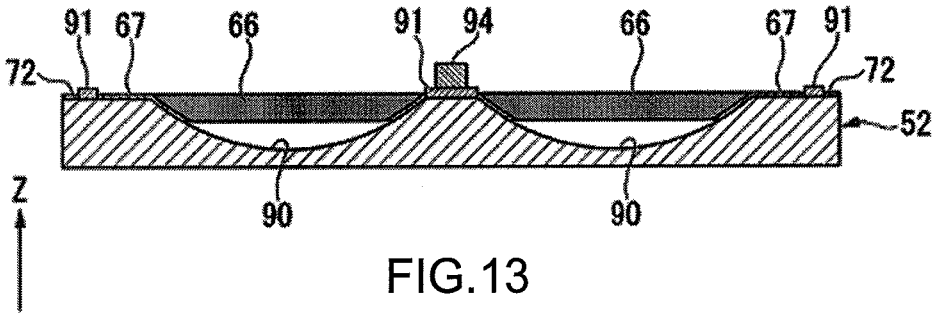
FIG. 13 is a step diagram for describing the method for manufacturing the ink jet head according to the first embodiment.
Figure 14:
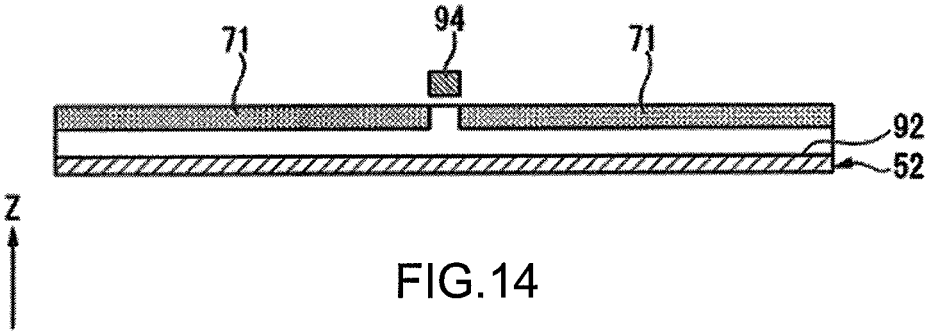
FIG. 14 is a step diagram for describing the method for manufacturing the ink jet head according to the first embodiment.

Then, as illustrated in FIGS. 6, 13, and 14, each of the electrodes 66, 71 and each of the pads 67, 72 are formed on the actuator plate 52 (the electrode forming step (S5)). In the electrode forming step (S5), oblique deposition is performed from the upper side of the actuator plate 52. Accordingly, a film of an electrode material is formed on the upper face of the actuator plate 52 and the inner faces of the recesses 90, 92 through the openings of the masks 91, 94. At this time, since a part corresponding to the communication portion 89 inside the second recess 92 is covered with the second mask 94, the film of the electrode material is not formed on this part. After the completion of the electrode forming step (S5), the masks 91, 94 are removed from the upper face of the actuator plate 52.

Figure 15:
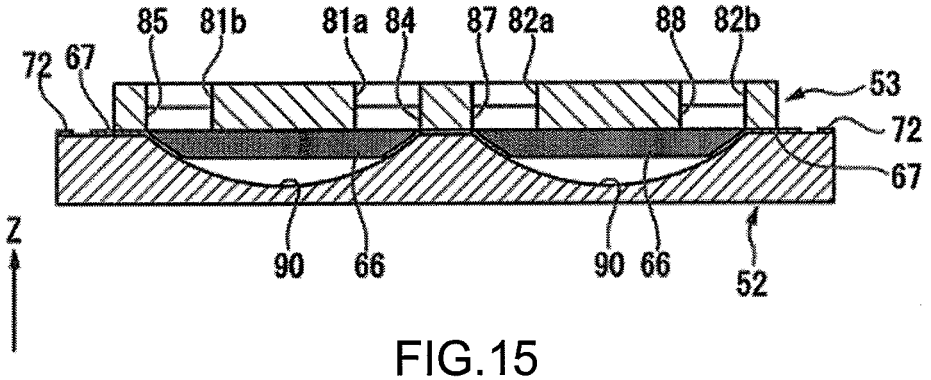
FIG. 15 is a step diagram for describing the method for manufacturing the ink jet head according to the first embodiment.

Then, as illustrated in FIGS. 6 and 15, the cover plate 53 is joined to the upper face of the actuator plate 52 (a cover plate joining step (S6)). Specifically, the cover plate 53 is jointed to the actuator plate 52 in such a manner that each of the supply slits 84, 87 communicates with the corresponding first recess 90 at an inner end in the channel extending direction, and each of the discharge slits 85, 88 communicates with the corresponding first recess 90 at an outer end in the channel extending direction.

Figure 16:
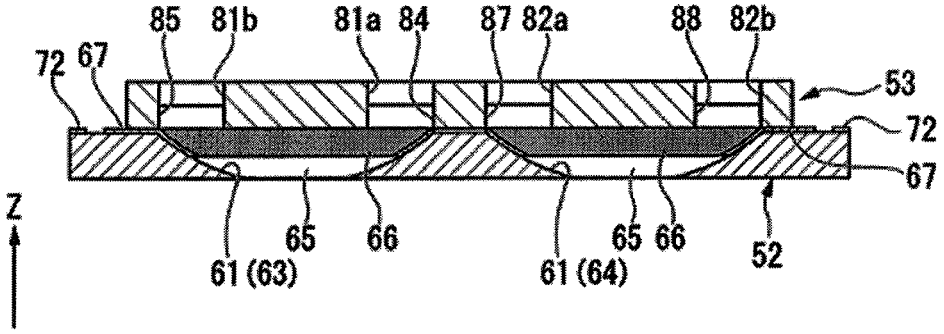
FIG. 16 is a step diagram for describing the method for manufacturing the ink jet head according to the first embodiment.
Figure 17:
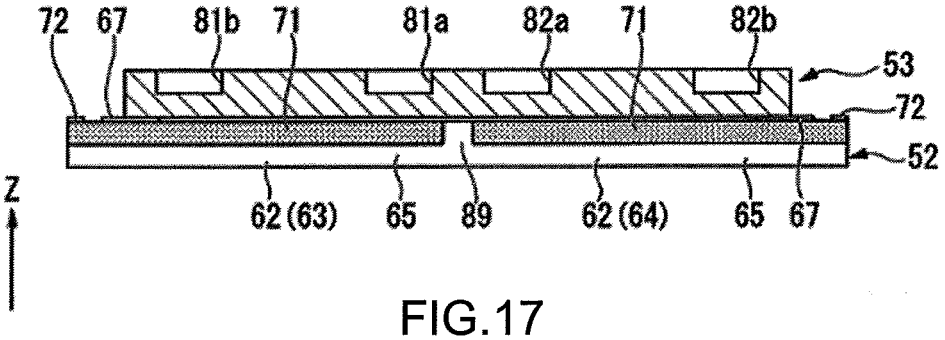
FIG. 17 is a step diagram for describing the method for manufacturing the ink jet head according to the first embodiment.

Then, as illustrated in FIGS. 6, 16, and 17, the actuator plate 52 is ground from the lower face so that each of the recesses 90, 92 penetrates the actuator plate 52 (a grinding step (S7)). Accordingly, the ejection channels 61 and the dummy channels 62 are formed on the actuator plate 52. Further, the communication portions 89 each of which allows the dummy channels 62 to communicate with each other are formed on the actuator plate 52 at positions located between the dummy channels 62 of the channel row 63 and the dummy channels 62 of the channel row 64.

Then, as illustrated in FIGS. 4 to 6, the nozzle plate 51 is joined to the lower face of the actuator plate 52 (a nozzle plate joining step (S8)).

Further, the flexible printed circuit boards 69, 70 are mounted on the tail parts of the actuator plate 52.

The ink jet head 5 of the present embodiment is manufactured by the above steps. In the above embodiment, the part corresponding to the communication portion 89 in the second recess 92 is covered with the second mask 94. However, the present invention is not limited to this configuration. For example, the part corresponding to the communication portion 89 in the second recess 92 may be covered with the first mask 91.

In this manner, in the present embodiment, each of the ejection channels 61 is symmetric with respect to a plane that passes through the center in the channel extending direction and perpendicular to the channel extending direction, and each of the dummy channels 62 is symmetric with respect to a plane that passes through the center in the channel extending direction and perpendicular to the channel extending direction.

This configuration enables the ejection channel 61 to be deformed with a good balance between one end side and the other end side in the channel extending direction when the ejection channel 61 is deformed in an expand and contract manner during the ejection of ink. Accordingly, it is possible to reduce the occurrence of an ejection failure such as deflection and obtain a stable ejection performance. Further, in the present embodiment, the dummy channel 62 is longer than the ejection channel 61 in the channel extending direction. Thus, the ejection channel 61 can be smoothly deformed in the entire range in the channel extending direction.

In the present embodiment, the ejection channel 61 of the channel row 63 and the ejection channel 61 of the channel row 64 which face each other in the channel extending direction are arranged on an identical straight line, and the dummy channel 62 of the channel row 63 and the dummy channel 62 of the channel row 64 which face each other in the channel extending direction are arranged on an identical straight line.

This configuration enables the ejection channel 61 to be more easily plane-symmetrically formed and enables the dummy channel 62 to be more easily plane-symmetrically formed compared to the case in which the ejection channels 61 are offset in the X direction and the dummy channels 62 are offset in the X direction.

In particular, the communication portion 89 which allows the dummy channels 62 facing each other in the channel extending direction between the channel rows 63, 64 to communicate with each other has a groove depth equal to that of the dummy channel 62. Thus, the dummy channel 62 can be more reliably and easily plane-symmetrically formed.

In the present embodiment, the cost can be reduced by forming the electrodes 66, 71 and the pads 67, 72 by deposition. Further, each of the individual electrodes 71 can be formed in a part of the inner face of the second recess 92 other than the inner face of the communication portion 89 in the channel extending direction by performing deposition using the masks 91, 94. As a result, it is possible to prevent the individual electrodes 71 formed on the inner faces of the dummy channels 62 that face each other in the channel extending direction between the channel rows 63, 64 from being electrically connected to each other through the inner face of the communication portion 89.

Since the pads 67, 72 are formed on the upper face of the actuator plate 52, the electrodes 66, 71 can be connected to the flexible printed circuit boards 69, 70 through the pads 67, 72. This enables the configuration to be simplified.

The nozzle holes 75 of the nozzle array 73 and the nozzle holes 76 of the nozzle row 74 are alternately arranged in a staggered form in the X direction and the channel extending direction.

This configuration enables the density of ink to be improved by causing ink ejected from the nozzle holes 75, 76 to land on an identical straight line along the X direction (the extending direction of each of the channel rows 63, 64) while moving the ink jet head 5 in the Y direction on the recording medium P. Accordingly, high resolution can be achieved.

The printer 1 of the present embodiment is provided with the ink jet head 5 described above. Thus, the printer 1 having high performance and high reliability can be provided.

(Second Embodiment)

Next, a second embodiment of the present invention will be described. The present embodiment differs from the above embodiment in that a common electrode 66*a* is formed on the lower half part of a channel 61, and an individual electrode 71*a* is formed on the lower half part of a channel 62. In the following description, a configuration similar to the configuration of the first embodiment will be designated by the same reference sign, and description thereof will be omitted.

Figure 18:
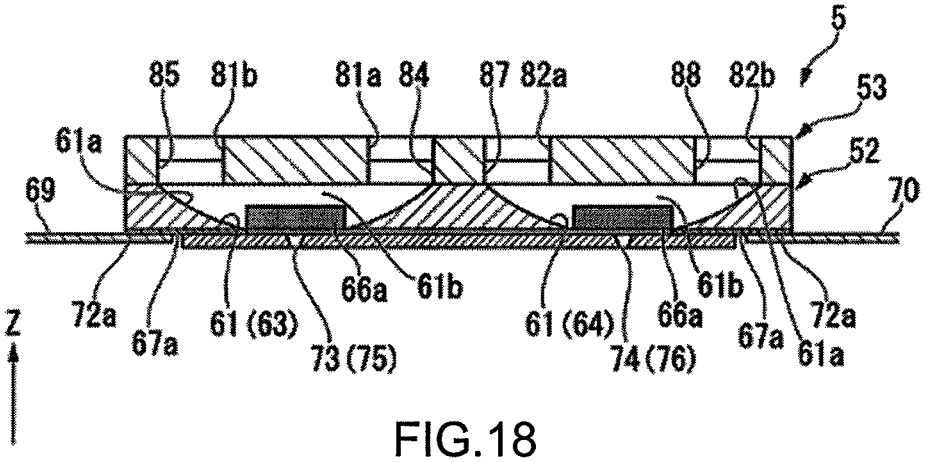
FIG. 18 is a sectional view of an ink jet head according to a second embodiment and corresponds to FIG. 4.

FIG. 18 is a sectional view of an ink jet head 5 according to the second embodiment and corresponds to FIG. 4.

In the ink jet head 5 illustrated in FIG. 18, the common electrodes 66*a* are formed on inner side faces that face each other in the X direction in the inner face of each ejection channel 61. The common electrode 66*a* is formed in a range of the ejection channel 61 from a lower edge to a central part in the Z direction. Further, the common electrode 66*a* is formed in a range equal to an intermediate part 61*b* of the ejection channel 61 in the channel extending direction.

An actuator plate 52 includes common pads 67*a* each of which is formed on the lower face of each tail part of the actuator plate 52. An inner end in the channel extending direction of the common pad 67*a* is connected to the common electrode 66*a* at a lower end opening edge of the ejection channel 61, and an outer end in the channel extending direction thereof terminates on the lower face of the tail part.

Figure 19:
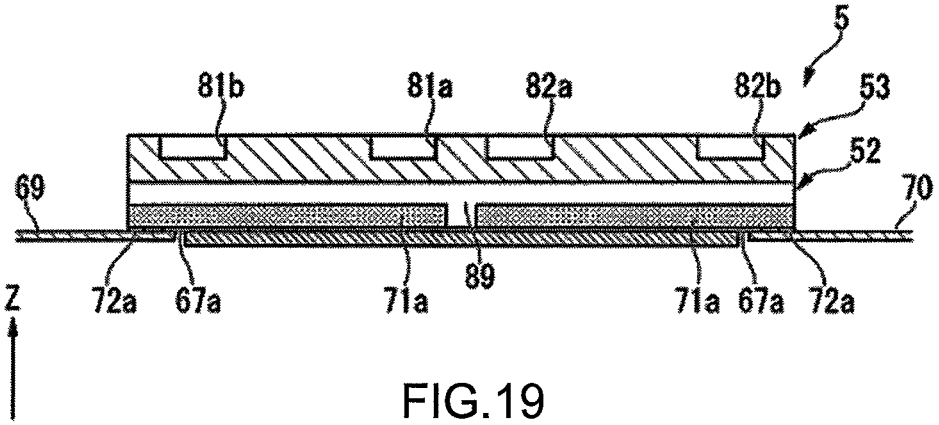
FIG. 19 is a sectional view of the ink jet head according to the second embodiment and corresponds to FIG. 5.

FIG. 19 is a sectional view of the ink jet head 5 according to the second embodiment and corresponds to FIG. 5.

On the other hand, as illustrated in FIG. 19, the individual electrodes 71*a* are formed on inner side faces that face each other in the X direction in the inner face of each dummy channel 62. The individual electrode 71*a* is formed in a range of the dummy channel 62 from a lower edge to a central part in the Z direction. Further, the individual electrode 71*a* is formed throughout the entire range in the channel extending direction of the dummy channel 62. Also in the present embodiment, no electrode material is adhered to a communication portion 89. Thus, the individual electrodes 71*a* of the dummy channels 62 that face each other in the channel extending direction across the communication portion 89 are electrically separated from each other by the communication portion 89.

The actuator plate 52 includes individual pads 72*a* each of which is formed on the lower face of each tail part of the actuator plate 52 and connects the individual electrodes 71*a* that face each other in the X direction across the ejection channel 61. The individual pad 72*a* is located on the outer side in the Y direction with respect to the common pad 67*a* and extends in the X direction on the tail part of the actuator plate 52.

The flexible printed circuit boards 69, 70 described above are connected to each of the pads 67*a*, 72*a* on the lower face of the tail parts.

Figure 20:
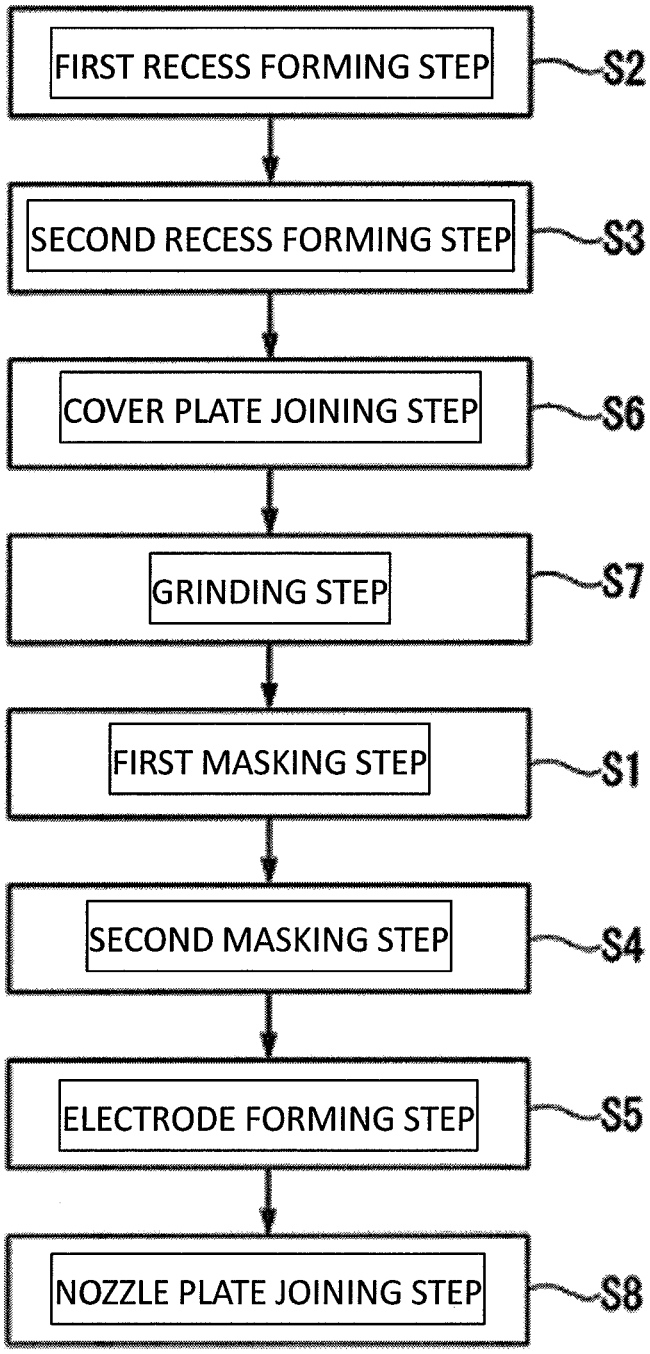
FIG. 20 is a flow chart for describing a method for manufacturing the ink jet head according to the second embodiment.

FIG. 20 is a flow chart for describing a method for manufacturing the ink jet head 5 of the second embodiment. In the following description, description of a step similar to the step of the first embodiment will be omitted.

As illustrated in FIG. 20, the present embodiment differs from the first embodiment in that the cover plate joining step (S6) and the grinding step (S7) are performed prior to the electrode forming step (S4).

That is, in the ink jet head 5 of the present embodiment, a first mask and a second mask (both not illustrated) are disposed on the lower face of the actuator plate 52 after the completion of the grinding step (S7). In this state, deposition is performed from the lower face of the actuator plate 52. Accordingly, the pads 67*a*, 72*a* are formed on the lower face of the actuator plate 52. Each of the electrodes 66*a*, 71*a* is formed on the lower half part inside the corresponding channel 61, 62 of the actuator plate 52.

(Third Embodiment)

Next, a third embodiment of the present invention will be described. The third embodiment differs from the first embodiment in that the electrodes 66, 71 and the pads 67, 72 are formed by electroless plating. In the following description, a configuration similar to the configuration of the first embodiment will be designated by the same reference sign, and description thereof will be omitted.

Figure 21:
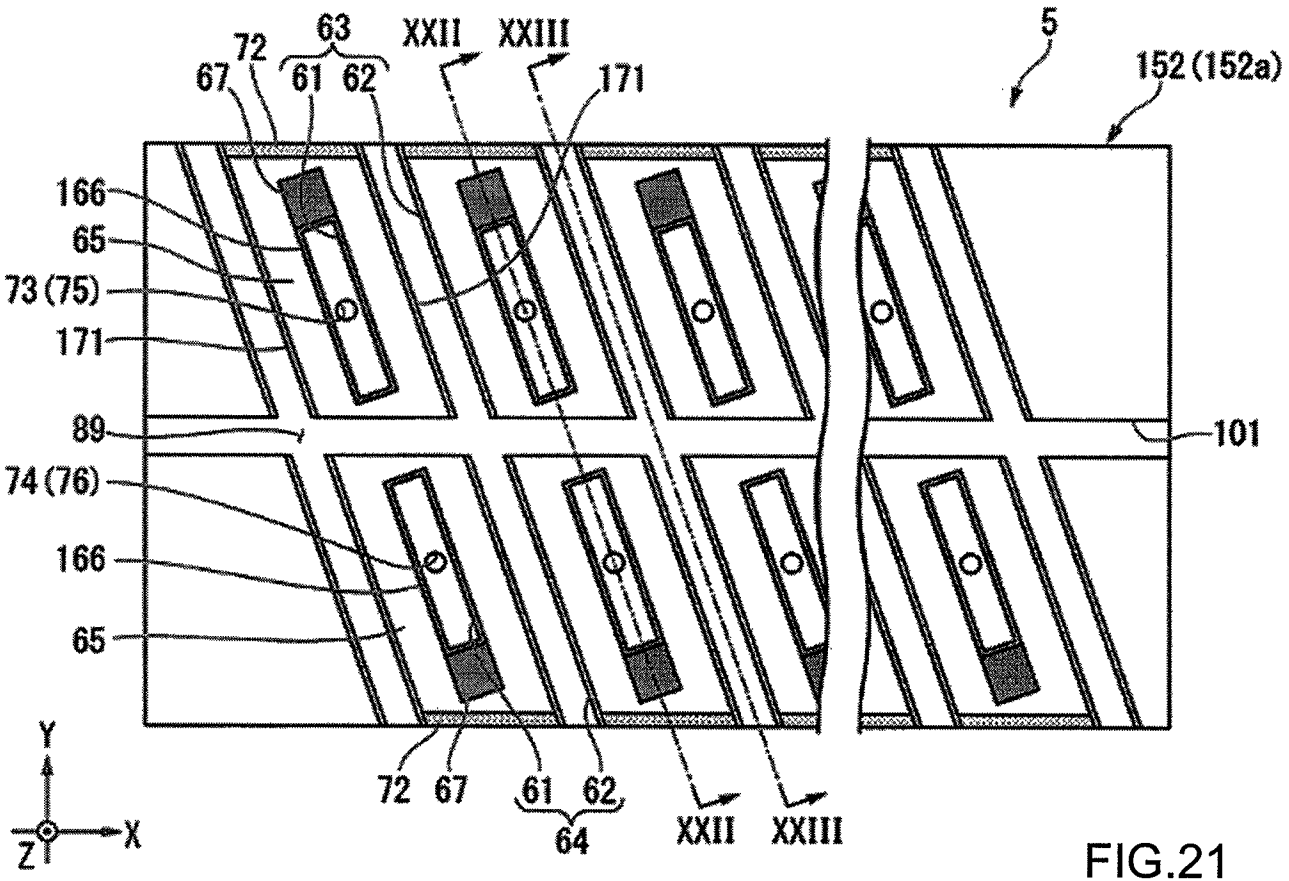
FIG. 21 is a plan view illustrating an ink jet head according to a third embodiment with a cover plate detached.
Figure 22:
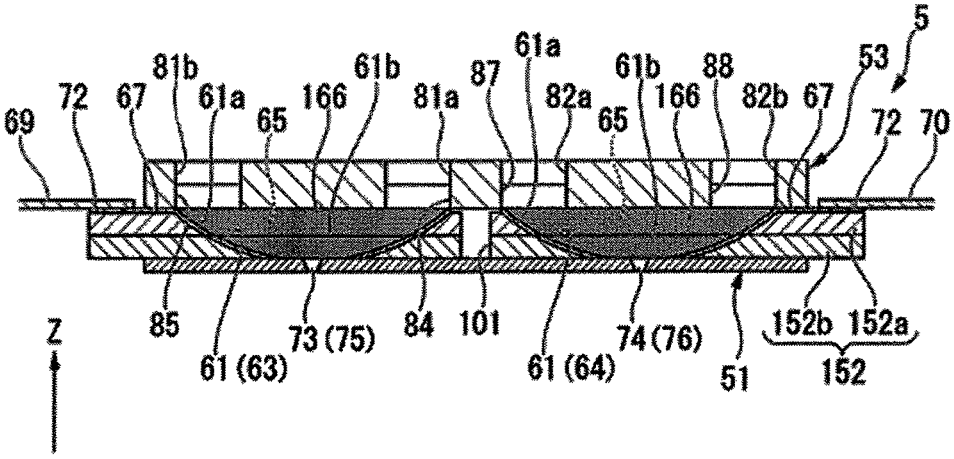
FIG. 22 is a sectional view taken along line XXII-XXII of FIG. 21.
Figure 23:
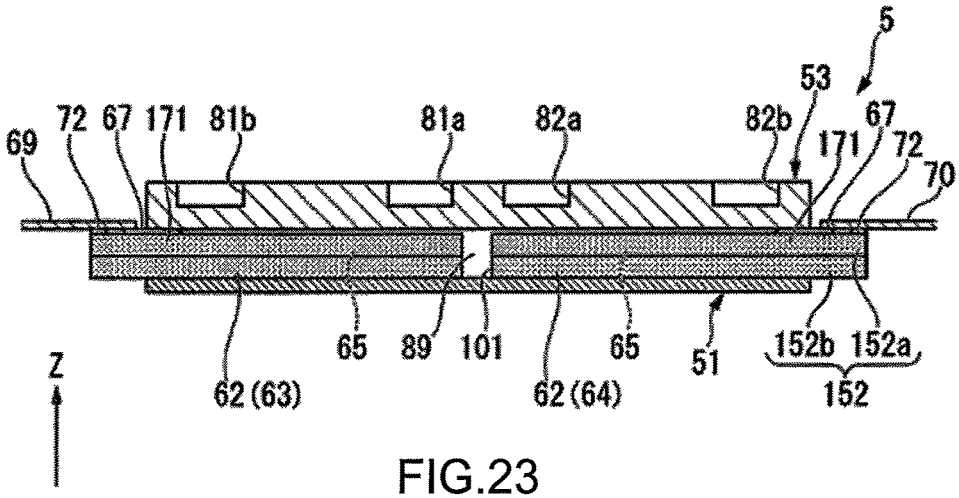
FIG. 23 is a sectional view taken along line XXIII-XXIII of FIG. 21.

FIG. 21 is a plan view illustrating an ink jet head 5 according to the third embodiment with a cover plate 53 detached. FIG. 22 is a sectional view taken along line XXII-XXII of FIG. 21. FIG. 23 is a sectional view taken along line XXIII-XXIII of FIG. 21.

As illustrated in FIGS. 21 to 23, in the ink jet head 5 of the present embodiment, an actuator plate 152 is a chevron substrate which includes two laminated piezoelectric plates (a first piezoelectric plate 152*a* and a second piezoelectric plate 152*b*) polarized in different directions in the Z direction.

In this case, a common electrode 166 is formed on the entire inner face of each ejection channel 61. Individual electrodes 171 are formed on the entire inner side faces that face each other in the X direction in the inner face of each dummy channel 62. That is, the individual electrode 171 is not formed on the bottom face of the dummy channel 62 (a part exposed inside the dummy channel 62 on the upper face of the nozzle plate 51). Thus, the individual electrodes 171 that face each other in the X direction in each dummy channel 62 are electrically separated from each other.

The actuator plate 152 includes a separation groove 101 which is formed on a part located between channel rows 63, 64 (a part in which the communication portions 89 are located) and separates between the channel rows 63, 64. The separation groove 101 has a groove depth equal to the groove depth of the dummy channel 62 and the communication portion 89. The separation groove 101 is formed throughout the entire range in the X direction of the actuator plate 152. However, it is only required that the outer ends in the X direction of the separation groove 101 be located on the outer side in the X direction with respect to the channel rows 63, 64. Further, it is only required that the separation groove 101 at least separate between the dummy channel 62 of the channel row 63 and the dummy channel 62 of the channel row 64 that face each other in the channel extending direction.

Figure 24:
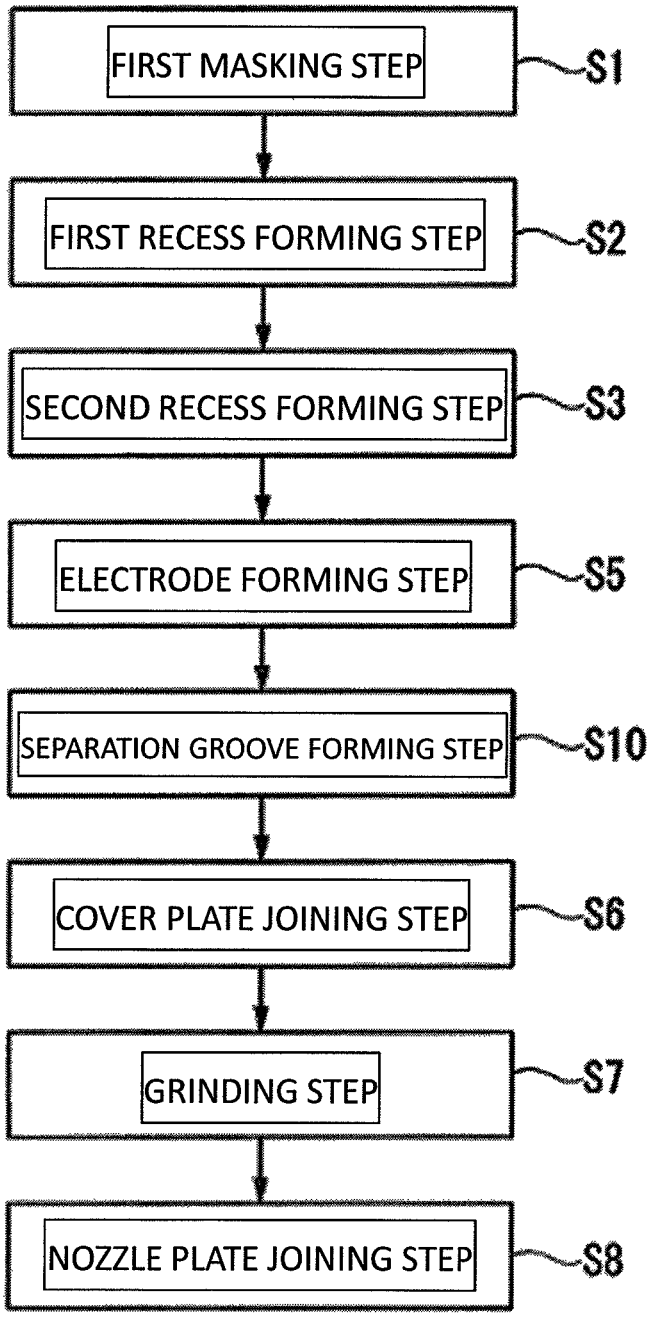
FIG. 24 is a flow chart for describing a method for manufacturing the ink jet head according to the third embodiment.
Figure 25:
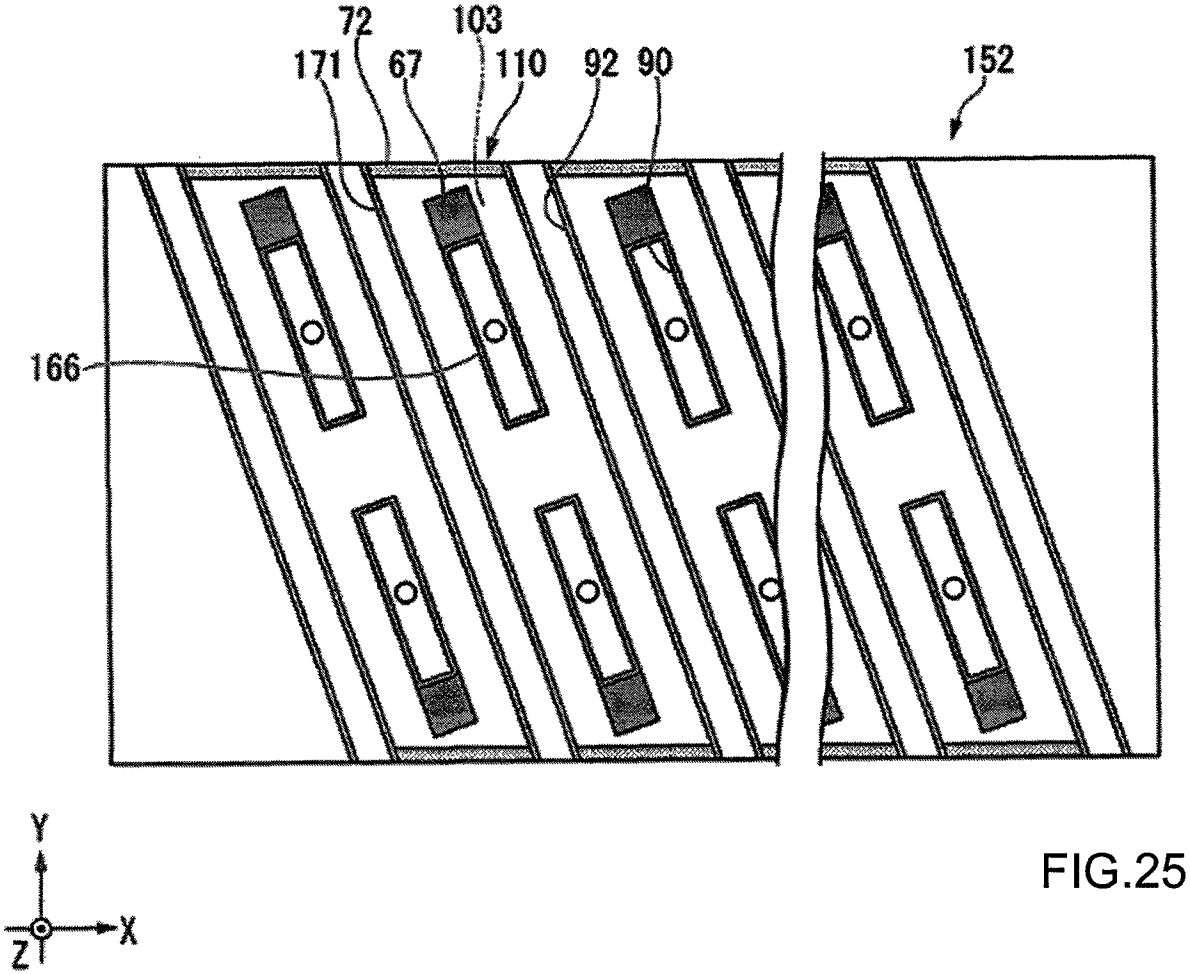
FIG. 25 is a step diagram for describing the method for manufacturing the ink jet head according to the third embodiment.

Next, a method for manufacturing the ink jet head 5 of the third embodiment will be described. FIG. 24 is a flow chart for describing the method for manufacturing the ink jet head 5 according to the third embodiment. FIG. 25 is a step diagram for describing the method for manufacturing the ink jet head 5. In the following description, description of a step similar to the step of the first embodiment will be omitted.

As illustrated in FIGS. 24 and 25, in an electrode forming step (S5) of the present embodiment, the electrodes 166, 171 and the pads 67, 72 are formed by electroless plating. In the electrode forming step (S5), a catalyst is first applied to formation regions of the electrodes 166, 171 and the pads 67, 72 (regions exposed through openings of a first mask 103) on the actuator plate 152. Specifically, the actuator plate 152 is immersed in a stannous chloride solution to allow stannous chloride to adsorb onto the surface of the actuator plate 152, that is, sensitizing is performed. Then, the actuator plate 152 is lightly cleaned by, for example, water washing. Then, the actuator plate 152 is immersed in a palladium chloride solution to allow palladium chloride to adsorb onto the surface of the actuator plate 152. Accordingly, an oxidation-reduction reaction occurs between the palladium chloride adsorbed on the surface of the actuator plate 152 and the stannous chloride adsorbed by the above sensitizing. As a result, metallic palladium is deposited as a catalyst (activating). Then, the actuator plate 152 with the catalyst (metallic palladium) applied is immersed in a plating solution.

Accordingly, a plating film 110 is deposited on the catalyst-applied part of the actuator plate 152.

Then, the separation groove 101 is formed on the actuator plate 152 (a separation groove forming step (S10)). The separation groove forming step (S10) is performed by, for example, cutting using a dicing blade. Specifically, the dicing blade is introduced into the actuator plate 152 from the upper side thereof at a part located between the channel rows 63, 64, and the actuator plate 152 and the dicing blade are relatively moved in the X direction. Accordingly, a part of the plating film 110 located inside each communication portion 89 is removed to separate between the individual electrodes 171 of the dummy channels 62 that face each other in the channel extending direction between the channel rows 63, 64.

Then, similarly to the first embodiment, the cover plate joining step (S6) and the steps thereafter are performed. Accordingly, the ink jet head 5 of the third embodiment is completed. In the above embodiment, electroless plating has been described as a method for forming the electrodes 166, 171 throughout the entire range in the Z direction on the inner faces of the channels 61, 62. However, the present invention is not limited to this method, and the electrodes 166, 171 may be formed by deposition. Further, the second mask forming step (S4) may be performed before the electrode forming step (S5) similarly to the first embodiment.

According to the present embodiment, the individual electrodes 171 inside the dummy channels 62 that face each other in the channel extending direction between the channel rows 63, 64 can be separated by the separation groove 101 when the plating film 110 is formed inside the channels 61, 62 by electroless plating in addition to that effects similar to the effects of the first embodiment can be achieved.

In the present embodiment, the electrode material adhered to the bottom face of each dummy channel 62 can be removed by performing the grinding step (S7) after the electrode forming step (S5). Accordingly, it is possible to prevent the individual electrodes 171 formed on the inner side faces that face each other in the X direction in the dummy channel 62 from being electrically connected to each other through the bottom face of the dummy channel 62.

Further, the communication portion 89 has a groove depth equal to that of the dummy channel 62. Thus, even if the electrode materials are adhered to the bottom faces of the second recesses 92 (the dummy channels 62 and the communication portions 89) in the electrode forming step (S5), the electrode materials can be collectively removed throughout the dummy channels 62 and the communication portions 89 in the grinding step (S7). As a result, it is possible to prevent the individual electrodes 171 formed on the inner side faces that face each other in the X direction in the inner face of the dummy channel 62 from being electrically connected to each other through the bottom face of the dummy channel 62 in each of the channel rows 63, 64. Although, in the above embodiment, the electrode material adhered to the bottom face of the second recess 92 is removed by the grinding step (S7), the present invention is not limited thereto. For example, the electrode material adhered to the bottom face of the second recess 92 may be removed by a laser or a dicing blade.

In the ink jet head 5, when W denotes the amount of heat generated in the actuator plate 152, C denotes a capacitance of the actuator plate 152 (drive walls 65), and V denotes a voltage applied to the actuator plate 152, a relationship of the following Equation (1) holds.

$$W=CV^2 \quad (1)$$

As represented by the above Equation (1), the amount of heat W generated in the actuator plate 152 is proportional to the capacitance C of the drive walls 65 and also proportional to the square of the voltage V. Thus, in order to reduce the heat generation in the actuator plate 152, it is preferred to deform the ejection channel 61 (drive walls 65) with a low voltage.

On the other hand, in the present embodiment, the area of each of the electrodes 166, 171 can be increased by forming the electrodes 166, 171 throughout the entire range in the Z direction on the inner faces of the channels 61, 62 of the actuator plate 152 which is a chevron substrate. Accordingly, it is possible to deform the ejection channel 61 (drive walls 65) with a low voltage. Thus, even when the width in the X direction of the drive walls 65 is reduced along with a reduction in the pitch, the heat generation in the ink jet head 5 caused by an increased in the capacitance C can be reduced.

(Fourth Embodiment)

Figure 26:
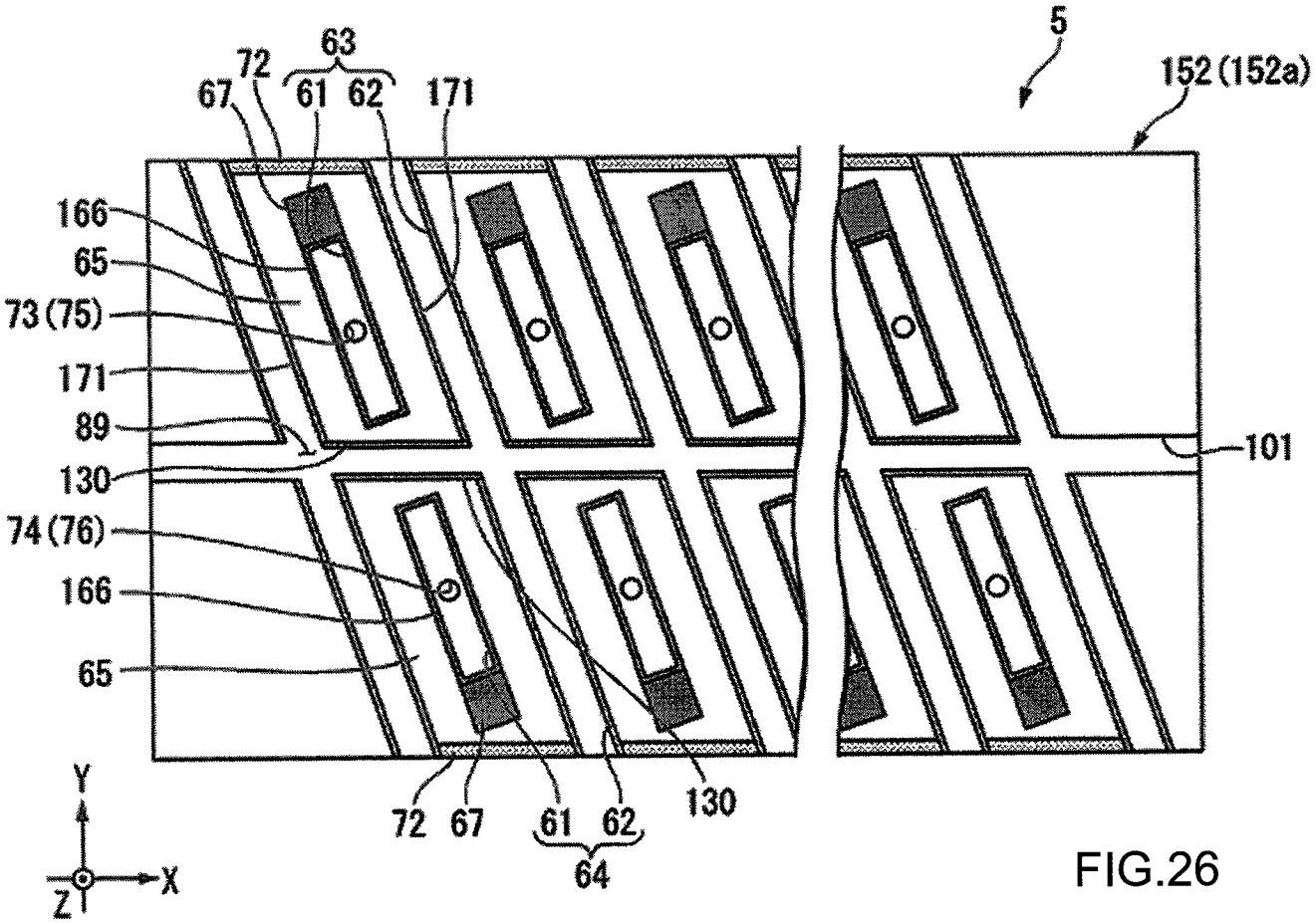
FIG. 26 is a plan view illustrating an ink jet head according to a fourth embodiment with a cover plate detached.

Next, a fourth embodiment will be described. The present embodiment differs from the third embodiment in that bypass electrodes 130 are formed on the inner face of the separation groove 101. FIG. 26 is a plan view illustrating an ink jet head 5 according to the fourth embodiment with a cover plate 53 detached.

In the ink jet head 5 illustrated in FIG. 26, the bypass electrodes 130 are formed on the inner face (inner side faces facing each other in the Y direction) of the separation groove 101. Each of the bypass electrodes 130 connects the individual electrodes 171 that face each other in the X direction across the ejection channel 61. The bypass electrodes 130 are formed throughout the entire inner side faces of the separation groove 101. One end in the X direction of the bypass electrode 130 is connected to the individual electrode 171 that is formed, inside the dummy channel 62 located on one end side in the X direction with respect to the ejection channel 61, on the other end side in the X direction. On the other hand, the other end in the X direction of the bypass electrode 130 is connected to the individual electrode 171 that is formed, inside the dummy channel 62 located on the other end side in the X direction with respect to the ejection channel 61, on one end side in the X direction.

When the ink jet head 5 of the present embodiment is manufactured, the separation groove forming step (S10) described above is performed at least prior to the electrode forming step (S5). Accordingly, in the electrode forming step (S5), the bypass electrodes 130 are formed on the inner side faces of the separation groove 101 simultaneously with the formation of the electrodes 166, 171 and the pads 67, 72.

This configuration makes it possible to achieve effects similar to the effects of the second embodiment and ensure reliability in the electrical connection between the individual electrodes 171 by connecting the individual electrodes 171 by the bypass electrodes 130.

(Fifth Embodiment)

Next, a fifth embodiment will be described. The present invention differs from the fourth embodiment in that pads 67*b*, 72*b* are formed on the lower face of an actuator plate 152. In the following description, a configuration similar to the configuration of the above embodiments will be designated by the same reference sign, and description thereof will be omitted.

Figure 27:
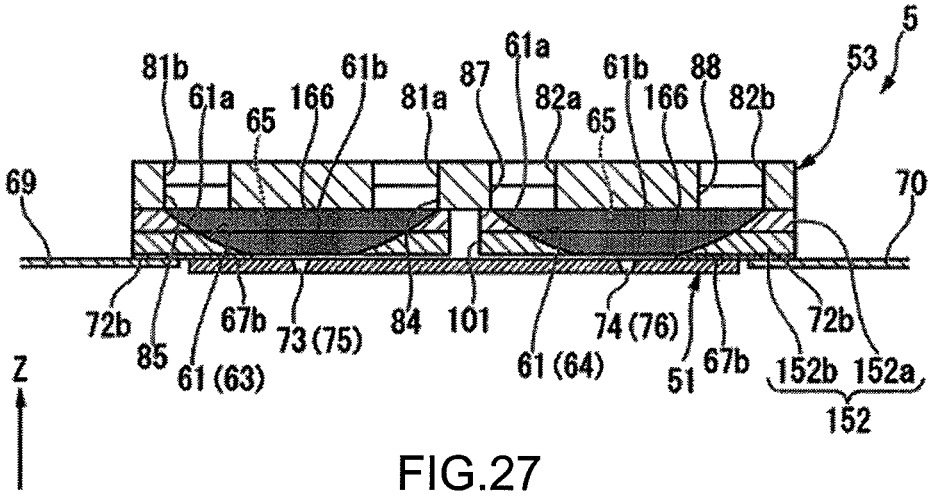
FIG. 27 is a sectional view of the ink jet head according to the fourth embodiment and corresponds to FIG. 22.

FIG. 27 corresponding to FIG. 22 of the ink jet head 5 according to forth embodiment is a sectional view.

In the ink jet head 5 illustrated in FIG. 27, the actuator plate 152 includes common pads 67*b* each of which is formed on the lower face of each tail part of the actuator plate 152. An inner end in the channel extending direction of the common pad 67*b* is connected to the common electrode 166 at a lower end opening edge of the ejection channel 61, and an outer end in the channel extending direction thereof terminates on the lower face of the tail part.

Figure 28:
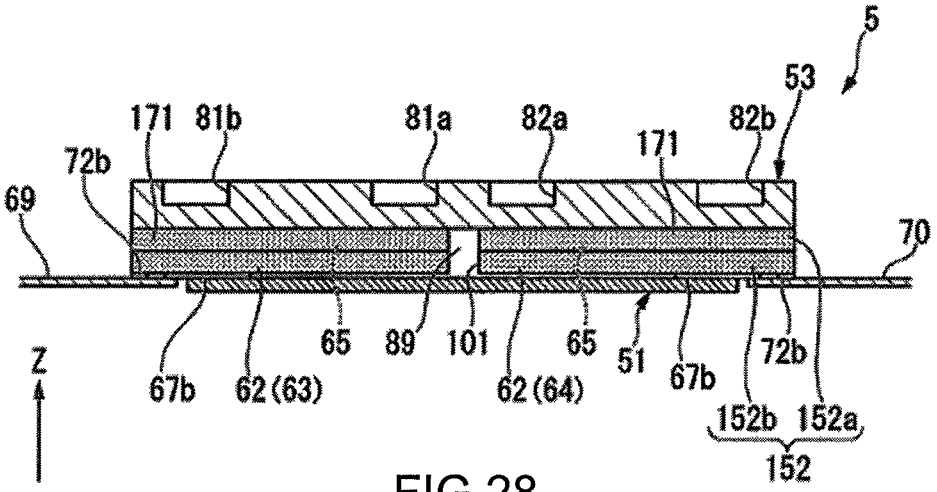
FIG. 28 is a sectional view of an ink jet head according to a fifth embodiment and corresponds to FIG. 23.

FIG. 28 is a sectional view of the ink jet head 5 according to the fifth embodiment and corresponds to FIG. 23.

As illustrated in FIGS. 27 and 28, the actuator plate 152 includes individual pads 72*b* each of which is formed on the lower face of each tail part of the actuator plate 152 and connects the individual electrodes 171 that face each other in the X direction across the ejection channel 61. The individual pad 72*b* is located on the outer side in the Y direction with respect to the common pad 67*b* and extends in the X direction on the lower face of the tail part of the actuator plate 52.

Figure 29:
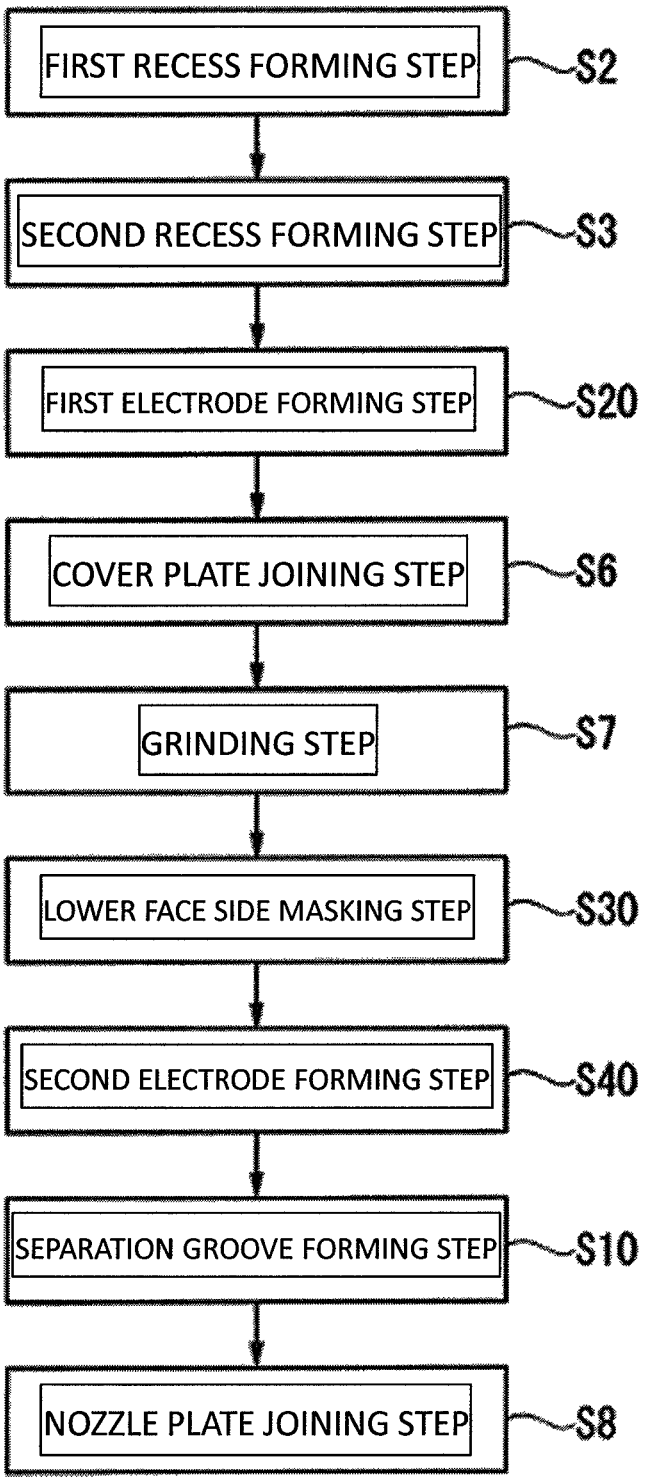
FIG. 29 is a flow chart for describing a method for manufacturing the ink jet head according to the fifth embodiment.

FIG. 29 is a flow chart for describing a method for manufacturing the ink jet head 5 of the fifth embodiment. In the following description, description of a step similar to the step of the first embodiment will be omitted.

As illustrated in FIG. 29, in the present embodiment, an upper face side mask (not illustrated) is first disposed on the upper face of the actuator plate 152. Then, the first recess forming step (S2) and the second recess forming step (S3) are performed similarly to the above embodiment.

Then, an electrode material to be the common electrodes 166 and the individual electrodes 171 is formed on the inner faces of the first recesses 90 and the inner faces of the second recesses 92 (a first electrode forming step (S20)). The first electrode forming step (S20) can be performed by, for example, electroless plating. The upper face side mask is removed after the first electrode forming step (S20).

Then, the cover plate joining step (S6) and the grinding step (S7) are performed similarly to the above embodiments.

Then, a lower face side mask which is used in a second electrode forming step (S40) described below is disposed on the lower face of the actuator plate 152 (a lower face side masking step (S30)). The lower face side mask has openings located in formation regions of the pads 67*b*, 72*b* on the lower face of the actuator plate 152.

Then, the pads 67*b*, 72*b* are formed on the actuator plate 152 (the second electrode forming step (S40)). In the second electrode forming step (S40), a film of an electrode material is formed on the lower face of the actuator plate 152 by, for example, deposition. Accordingly, the film of the electrode material is formed on the lower face of the actuator plate 152 through the openings of the lower face side mask, so that the pads 67*b*, 72*b* are formed. The lower face side mask is removed from the lower face of the actuator plate 152 after the completion of the second electrode forming step (S40).

Then, the separation groove forming step (S10) and the nozzle plate joining step (S8) are performed similarly to the above embodiments to complete the ink jet head 5 of the present embodiment.

(Sixth Embodiment)

Next, a sixth embodiment will be described. The present embodiment differs from the above embodiments in that four channel rows 200 to 204 are formed. In the following description, a configuration similar to the configuration of the above embodiments will be designated by the same reference sign, and description thereof will be omitted.

Figure 30:
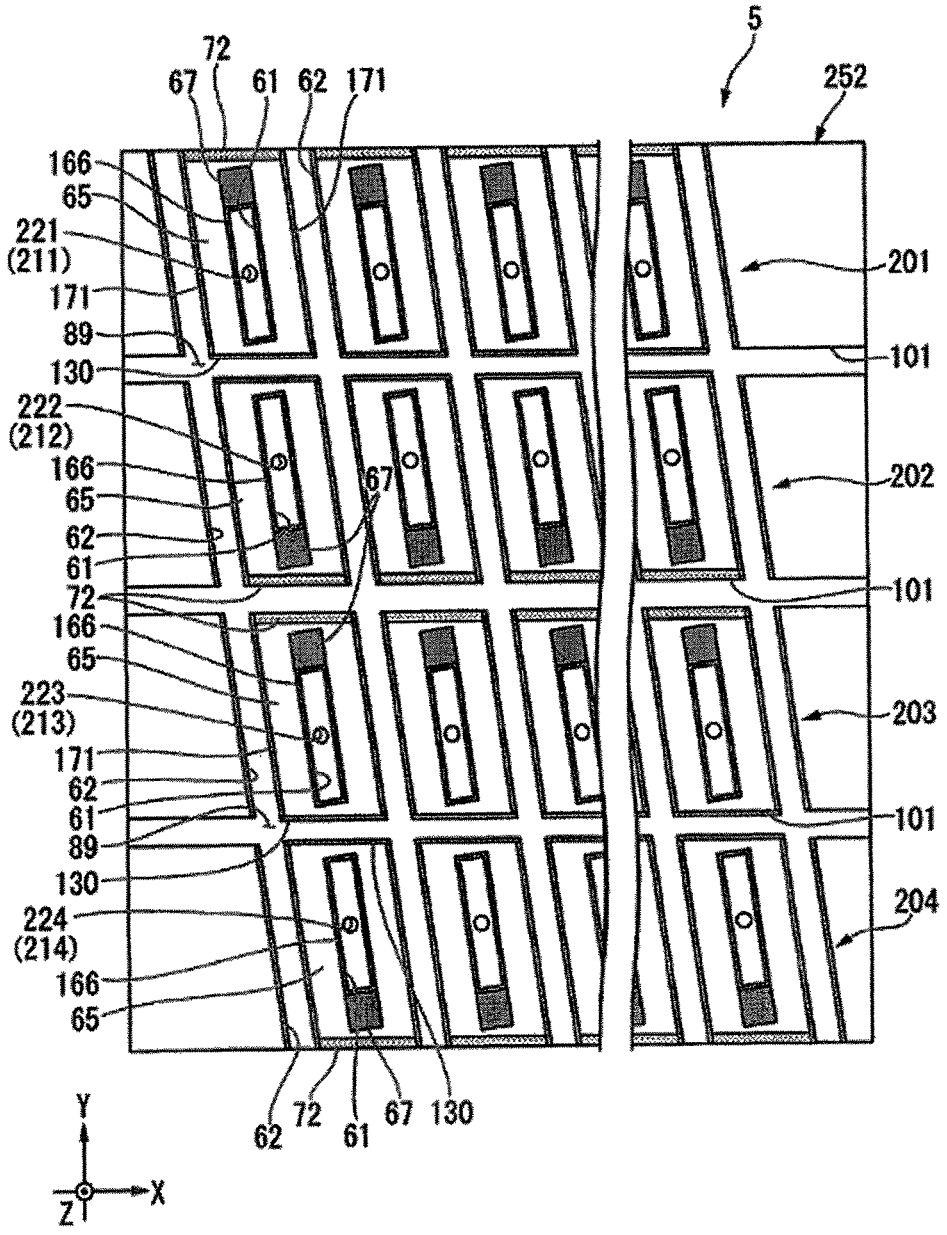
FIG. 30 is a plan view of an ink jet head according to a sixth embodiment with a cover plate detached.

FIG. 30 is a plan view illustrating an ink jet head 5 according to the sixth embodiment with a cover plate 53 detached.

In the ink jet head 5 illustrated in FIG. 30, an actuator plate 252 includes a plurality of channel rows (a first channel row 201, a second channel row 202, a third channel row 203, and a fourth channel row 204) which are arrayed at intervals in the Y direction. In the channel rows 201 to 204, channel rows adjacent to each other in the Y direction correspond to the first channel row and the second channel row in the claims.

In each of the channel rows 201 to 204, ejection channels 61 and dummy channels 62 are alternately arranged side by side in the X direction. The ejection channels 61 of the channel rows 201 to 204 which face each other in the channel extending direction are arranged on an identical straight line in the channel extending direction. Further, the dummy channels 62 of the channel rows 201 to 204 which face each other in the channel extending direction are arranged on an identical straight line in the channel extending direction. The actuator plate 252 includes separation grooves 101, each of which is formed between each adjacent two of the channel rows 201 to 204.

In the present embodiment, a nozzle plate (not illustrated) includes nozzle holes 211 communicating with the ejection channels 61 of the channel row 201, nozzle holes 212 communicating with the ejection channels 61 of the channel row 202, nozzle holes 213 communicating with the ejection channels 61 of the channel row 203, and nozzle holes 214 communicating with the ejection channels 61 of the channel row 204. The nozzle holes 211 are arrayed at intervals in the X direction at a position corresponding to the channel row 201 in the Y direction to form a first nozzle array 221. The nozzle holes 212 are arrayed at intervals in the X direction at a position corresponding to the channel row 202 in the Y direction to form a second nozzle array 222. The nozzle holes 213 are arrayed at intervals in the X direction at a position corresponding to the channel row 203 in the Y direction to form a third nozzle array 223. The nozzle holes 214 are arrayed at intervals in the X direction at a position corresponding to the channel row 204 in the Y direction to form a fourth nozzle array 224.

In each of the nozzle arrays 221 to 224, the nozzle holes 211 to 214 are arrayed at the same pitch in the X direction. Further, the nozzle holes 211 to 214 are formed at positions offset in the X direction. In this case, the nozzle holes 211 to 214 are offset by every quarter pitch of the arraying pitch of the nozzle holes 211 to 214. The offset amount of the nozzle holes 211 to 214 can be appropriately changed.

In the channel rows 201 to 204, electrodes 166, 171 of the first channel row 201 and electrodes 166, 171 of the fourth channel rows 204 are connected to flexible printed circuit boards through pads 67, 72 at the respective ends in the Y direction of the actuator plate 252. Electrodes 166, 171 of the second channel row 202 and electrodes 166, 171 of the third channel row 203 are connected to a flexible printed circuit board (not illustrated) which is inserted through a through hole formed on a cover plate (not illustrated) through pads 67, 72 at a position between the second channel row 202 and the third channel row 203 on the actuator plate 252. A method for connecting the flexible printed circuit board and the electrodes 166, 171 can be appropriately changed.

This configuration makes it possible to further improve the density of ink and achieve high resolution. In the above embodiment, the four channel rows are formed. However, three channel rows or a plurality of channel rows of five or more channel rows may be formed.

(Seventh Embodiment)

Figure 31:
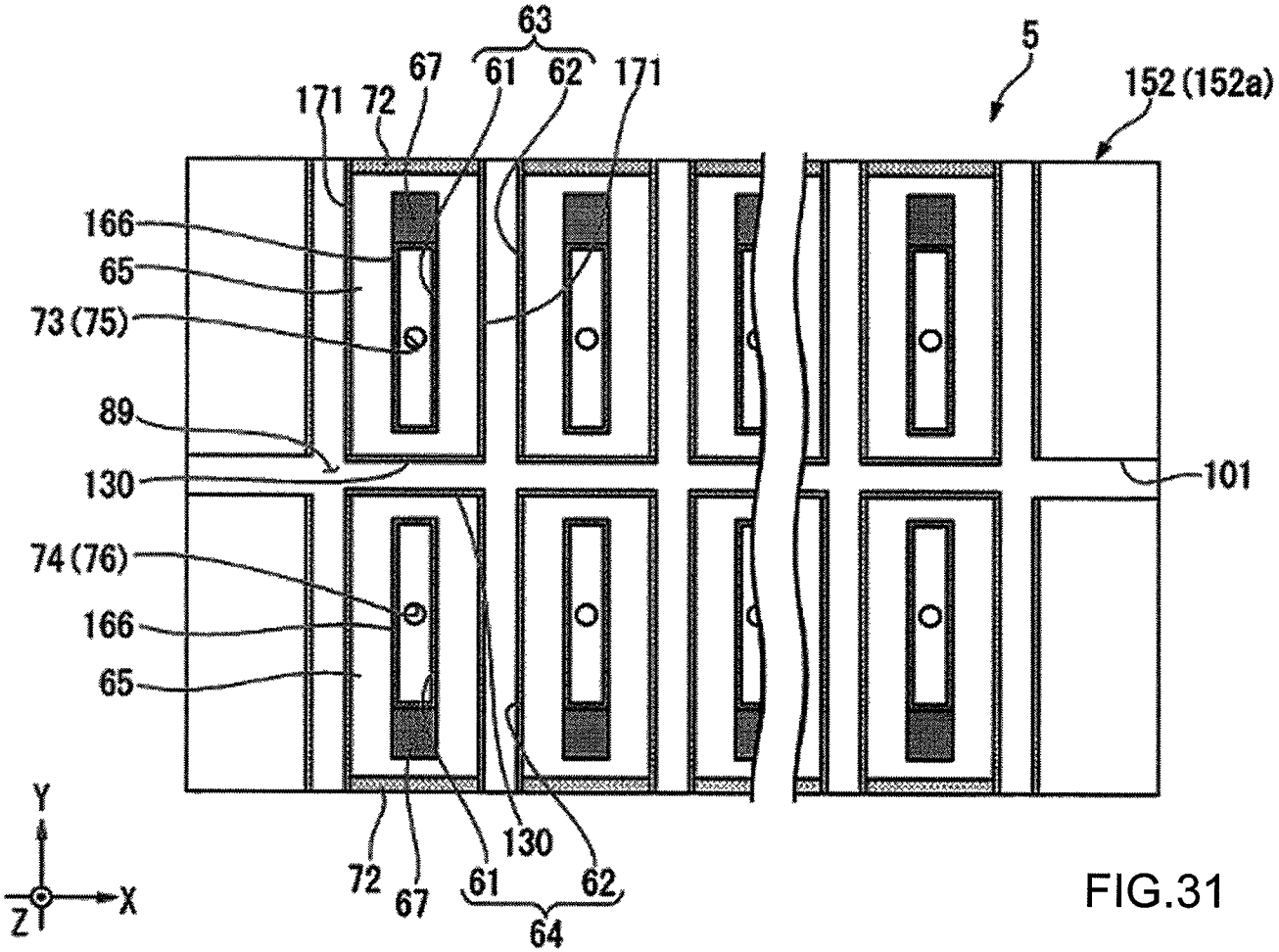
FIG. 31 is a plan view of an ink jet head according to a seventh embodiment with a cover plate detached.

Next, a seventh embodiment of the present invention will be described. The present embodiment differs from each of the above embodiments in that the channel extending direction of each channel 61, 62 is aligned with the Y direction. FIG. 31 is a plan view illustrating an ink jet head 5 according to the seventh embodiment with a cover plate 53 detached.

As illustrated in FIG. 31, in the ink jet head 5 of the present embodiment, each ejection channel 61 and each dummy channel 62 are linearly formed along the Y direction (channel extending direction (first direction)). In each of the channel rows 63, 64, the ejection channels 61 are formed at an equal arraying pitch in the X direction, and the dummy channels 62 are formed at an equal arraying pitch in the X direction. Thus, the ejection channels 61 are formed at the same positions in the X direction and the dummy channels 62 are formed at the same positions in the X direction between the channel rows 63, 64. Thus, in the nozzle plate 51, each of the nozzle holes 75 of the nozzle array 73 is formed at the same position in the X direction as the corresponding nozzle hole 76 of the nozzle array 74.

In this configuration, the ejection channels 61 of the channel row 63 and the ejection channels 61 of the channel row 64 are formed at the same positions in the X direction. Thus, it is possible to increase the number of nozzles in the scanning direction (Y direction) of the ink jet head 5 and achieve high speed printing. Also in the present embodiment, the configurations of the above third to sixth embodiments can be appropriately employed. In the present embodiment, in the channel row 63, both the ejection channel 61 and the dummy channel 62 may be symmetric with respect a plane that passes through the nozzle hole 75 and perpendicular to the Y direction. Further, in the channel row 64, both the ejection channel 61 and the dummy channel 62 may be symmetric with respect to a plane that passes through the nozzle hole 76 and perpendicular to the Y direction.

A technical range of the present invention is not limited to the above embodiments. Various modifications can be added without departing from the gist of the invention.

For example, in the above embodiments, the ink jet printer 1 has been described as an example of the liquid jet apparatus. However, the liquid jet apparatus is not limited to a printer. For example, the liquid jet apparatus may be a fax machine or an on-demand printing machine.

In the above embodiments, the common pad and the individual pad are formed on the same face (the upper face or the lower face) of the actuator plate. However, the present invention is not limited to this configuration. For example, either the common pad or the individual pad may be formed on either the upper face or the lower face of the actuator plate, and the other pad may be formed on the other face.

In the above embodiments, the nozzle hole communicates with the inside of the ejection channel at the central part in the Y direction or the channel extending direction in the ejection channel. However, the present invention is not limited to this configuration. That is, the nozzle hole may offset from the central part as long as the nozzle hole communicates with the inside of the ejection channel at a midway part in the Y direction or the channel extending direction in the ejection channel (a part that penetrates the actuator plate).

In the above embodiments, the ink jet head is a side shoot and circulation type ink jet head that circulates ink between the ink jet head 5 and the ink tank 4. However, the present invention is not limited to this configuration.

In the above embodiments, the dummy channels 62 penetrate the actuator plate in the Z direction. However, the present invention is not limited to this configuration.

In the above embodiments, the communication portions 89 each of which allows the dummy channels 62 to communicate with each other between the channel rows 63, 64 are formed. However, the communication portion 89 may not be provided as long as the dummy channels 62 are plane-symmetrically formed. The ejection channel 61 and the dummy channel 62 may have the same shape.

In addition to the above, each constituent element in the above embodiments can be appropriately replaced with a known constituent element or the above modified examples may be appropriately combined without departing from the gist of the invention.

What is claimed is:

1. A liquid jet head comprising:

an actuator plate;

a plurality of jet channels formed on the actuator plate, each of the jet channels extending lengthwise along a first direction and being filled with liquid;

a plurality of dummy channels formed on the actuator plate, each of the dummy channels extending lengthwise along the first direction and not being filled with liquid;

a jet hole plate laminated on the actuator plate and including a plurality of jet holes, each of the jet holes communicating with a corresponding one of the jet channels at a midway part in the first direction of the jet channel, wherein the actuator plate includes a first channel row including the jet channels and the dummy channels alternately arranged side by side in a second direction intersecting the first direction and a second channel row including the jet channels and the dummy channels alternately arranged side by side in the second direction, the first channel row and the second channel row being spaced apart from each other in the first direction, each of the jet channels is symmetric with respect to a plane that passes through a center of the jet channel in the first direction and perpendicular to the first direction, and each of the dummy channels is symmetric with respect to a plane that passes through a center of the dummy channel in the first direction and perpendicular to the first direction.

2. The liquid jet head according to claim 1, wherein each of the jet channels of the first channel row and each of the jet channels of the second channel row which face each other in the first direction are arranged on an identical straight line along the first direction, and each of the dummy channels of the first channel row and each of the dummy channels of the second channel row which face each other in the first direction are arranged on an identical straight line in the first direction.

3. The liquid jet head according to claim 1, wherein the dummy channels of the first channel row and the dummy channels of the second channel rows are open on respective end faces in the first direction of the actuator plate, the actuator plate includes communication portions configured to allow the dummy channels of the first channel row and the dummy channels of the second channel row to communicate with each other, the communication portions being formed between the first channel row and the second channel row, and the communication portions have a groove depth equal to a groove depth of the dummy channels.

4. The liquid jet head according to claim 1, further comprising:

a plurality of common electrodes formed on inner faces of the jet channels; and a plurality of individual electrodes formed on inner side faces facing each other in the second direction in inner faces of the dummy channels.

5. The liquid jet head according to claim 4, wherein the actuator plate includes a plurality of individual pads formed on a principal face of the actuator plate or a face opposite to the principal face, each of the individual pads being configured to connect the corresponding two of the individual electrodes facing each other in the second direction across the jet channel.

6. The liquid jet head according to claim 4, wherein the actuator plate includes a plurality of common pads formed on a principal face of the actuator plate or a face opposite to the principal face, the common pads being connected to the common electrodes.

7. The liquid jet head according to claim 4, wherein the actuator plate includes communication portions formed between the first channel row and the second channel row, each of the communication portions being configured to allow each of the dummy channels of the first channel row and each of the dummy channels of the second channel row which face each other in the first direction to communicate with each other, and the individual electrodes are formed in a part other than inner faces of the communication portions in the inner faces of the corresponding dummy channels of the first channel row and the second channel row and the corresponding communication portions.

8. The liquid jet head according to claim 4, wherein the actuator plate includes communication portions formed between the first channel row and the second channel row, each of the communication portions being configured to allow each of the dummy channels of the first channel row and each of the dummy channels of the second channel row which face each other in the first direction to communicate with each other, and the actuator plate includes a separation groove formed between the first channel row and the second channel row, the separation groove being configured to electrically separate the individual electrodes at least between each of the dummy channels of the first channel row and each of the dummy channels of the second channel row which face each other in the first direction.

9. The liquid jet head according to claim 8, wherein bypass electrodes are formed on an inner face of the separation groove, each of the bypass electrodes being configured to connect the corresponding two of the individual electrodes facing each other in the second direction across the jet channel.

10. The liquid jet head according to claim 4, wherein the actuator plate includes a first piezoelectric plate and a second piezoelectric plate that are polarized in different directions in a third direction corresponding to a groove depth direction of the jet channels and the dummy channels, the first piezoelectric plate and the second piezoelectric plate being laminated in the third direction, the common electrodes are formed across the first piezoelectric plate and the second piezoelectric plate on the inner faces of the jet channels, and the individual electrodes are formed across the first piezoelectric plate and the second piezoelectric plate on the inner side faces facing each other in the second direction in the inner faces of the dummy channels.

11. The liquid jet head according to claim 1, wherein the jet holes include:

first jet holes communicating with the respective jet channels of the first channel row; and second jet holes communicating with the respective jet channels of the second channel row, wherein the first jet holes and the second jet holes are alternately arrayed in a staggered form in the second direction.

12. A liquid jet apparatus comprising:

the liquid jet head according to claim 1; and a movement mechanism configured to relatively move the liquid jet head and a recording medium.

13. The liquid jet head according to claim 1, wherein the length of the dummy channels is longer than the length of the jet channels.

14. The liquid jet head according to claim 1, wherein outer ends of the dummy channels terminate on an outer face of the actuator plate.

15. The liquid jet head according to claim 1, wherein, in each of the first and second channel rows, opposite end portions of the dummy channels overlap opposite ends of adjacent jet channels.

16. The liquid jet head according to claim 1, wherein the dummy channels in the first channel row are axially aligned with respective dummy channels in the second channel row, and the dummy channels in each aligned pair comprise different sections of a common channel formed on the actuator plate.

* * * * *